US009011161B2

(12) United States Patent
Weber et al.

(10) Patent No.: US 9,011,161 B2
(45) Date of Patent: Apr. 21, 2015

(54) RETENTION MECHANISM DEVICE HAVING A LUBRICATING MEMBER

(75) Inventors: Douglas J. Weber, Arcadia, CA (US); Naoto Matsuyuki, Nagoya (JP); Jason S. Sloey, Cedar Park, TX (US); Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 56 days.

(21) Appl. No.: 13/607,497

(22) Filed: Sep. 7, 2012

(65) Prior Publication Data

US 2013/0244472 A1 Sep. 19, 2013

Related U.S. Application Data

(60) Provisional application No. 61/597,705, filed on Feb. 10, 2012, provisional application No. 61/602,057, filed on Feb. 22, 2012, provisional application No. 61/693,228, filed on Aug. 24, 2012.

(51) Int. Cl.

| | |
|---|---|
| ***H01R 39/00*** | (2006.01) |
| ***H01R 41/00*** | (2006.01) |
| ***H01R 13/62*** | (2006.01) |
| ***H01R 13/627*** | (2006.01) |
| ***H01R 43/26*** | (2006.01) |
| *H01R 24/62* | (2011.01) |

(52) U.S. Cl.

CPC ..... *H01R 13/62* (2013.01); *H01R 13/627* (2013.01); *H01R 13/6275* (2013.01); *H01R 43/26* (2013.01); *H01R 24/62* (2013.01); *H01R 2201/06* (2013.01)

(58) Field of Classification Search

USPC ..... 439/3, 350, 353, 370

See application file for complete search history.

(56) References Cited

U.S. PATENT DOCUMENTS

| | | | | |
|---|---|---|---|---|
| 6,149,451 | A | 11/2000 | Weber | |
| 6,346,157 | B1 | 2/2002 | Takezawa et al. | |
| 6,406,320 | B1 | 6/2002 | Wu | |
| 7,033,218 | B2 * | 4/2006 | Huang et al. | 439/607.04 |
| 7,223,113 | B2 * | 5/2007 | Nakamura et al. | 439/353 |
| 7,445,486 | B2 * | 11/2008 | Shen et al. | 439/353 |

(Continued)

OTHER PUBLICATIONS

Non-Final Office Action mailed on Jan. 29, 2014 for U.S. Appl. No. 13/607,600, 7 pages.

(Continued)

*Primary Examiner* — Hae Moon Hyeon

(74) *Attorney, Agent, or Firm* — Kilpatrick Townsend & Stockton LLP

(57) ABSTRACT

A retention latch mechanism having corresponding retention features and stress reducing members is provided herein. In an example embodiment, the retention latch mechanism comprises a pair of spring arm retention features of a receptacle engageable with a corresponding pair of recessed retention features of an insertable tab and one or more backup spring members for reducing stress within the spring arms during insertion of the tab into the receptacle. The backup spring is positioned adjacent an outward facing surface such that outward lateral deflection of the spring arms deflects the backup spring thereby reducing force within the spring arm. In some embodiments, the backup spring includes any or all of a bent portion of an associated bracket or arm member, a wire, a loop, a complementary spring arm, dual backup springs, elastomeric members and self-lubricating members. Methods of providing retention of a tab within a receptacle are also provided herein.

14 Claims, 25 Drawing Sheets

(56) References Cited

U.S. PATENT DOCUMENTS

| | | | | |
|---|---|---|---|---|
| 8,297,603 | B2 | 10/2012 | Imaizumi et al. | |
| 8,308,150 | B2 | 11/2012 | Tange et al. | |
| 8,485,839 | B2 * | 7/2013 | Morgan et al. | 439/353 |
| 8,533,954 | B2 | 9/2013 | Tange et al. | |
| 8,607,605 | B2 | 12/2013 | Tange et al. | |
| 2007/0054536 | A1 * | 3/2007 | Nakamura | 439/353 |
| 2009/0133785 | A1 | 5/2009 | Ayada et al. | |
| 2013/0210261 | A1 | 8/2013 | Weber et al. | |
| 2014/0057479 | A1 | 2/2014 | Weber et al. | |

OTHER PUBLICATIONS

Notice of Allowance mailed on Dec. 5, 2014 for U.S. Appl. No. 13/675,909, 7 pages.

* cited by examiner

Linear analysis
- Load [N]: 8.8
- Maximum stress [N/mm$^2$]:1318

RETENTION MECHANISM DEVICE HAVING A LUBRICATING MEMBER

CROSS-REFERENCES TO RELATED APPLICATIONS

The present application is a non-provisional of, and claims the benefit of U.S. Provisional Patent Application No, 61/597,705, filed Feb. 10, 2012; U.S. Provisional Patent Application No. 61/602,057, filed Feb. 22, 2012; and U.S. Provisional Patent Application No. 61/693,228, filed Aug. 24, 2012, each of which the entire contents are incorporated herein by reference.

BACKGROUND OF THE INVENTION

The present invention relates generally to retention mechanisms, and in particular retention mechanisms for use in electrical connectors.

Many devices include electrical connectors to facilitate communication between devices and/or recharging of the device by electrically coupling the device to an external power source. In a typical electrical connector system an electrical connection can be made between a connector plug and a corresponding connector receptacle by inserting the connector plug into the corresponding connector receptacle. Generally, the connector plug includes a group of electrical contacts that engage and electrically couple with corresponding electrical contacts within the connector receptacle when connected. To establish contact between corresponding contacts, an electrical connector is generally designed so that the contact carrying portion of the connector plug is fittingly received within the receptacle so as to provide a normal force on the connector plug to help maintain adequate electrical contact between the components as well as to hold the connector plug in place. In many conventional connector designs, the normal force is limited by the tightness of the fit, which often degrades over time as the connector is subjected to many cycles of use. Despite such designs, in many connector devices, the electrical plug can inadvertently become misaligned, partially withdrawn, or removed from the receptacle entirely. Additionally, many conventional designs provide little or no indication as to when the connector plug is properly positioned within the receptacle so that a user may unknowingly insert the connector plug in such a manner that the electrical contacts are not fully engaged and do not properly function.

In addition, to ensure proper contact is maintained between corresponding contacts, an electrical connector typically includes interfacing features or retaining features that interface or engage to retain the connector plug within the connector receptacle. In some instances these interfacing surfaces or features are lubricated to facilitate insertion and removal of the connector plug. After many cycles of use, however, the lubrication may be worn away such that the connector returns to a non-lubricated state. The increased friction or wear and tear on interfacing surfaces in a non-lubricated state may degrade the ability to easily insert and remove the connector plug from the receptacle as well as the integrity of the connection when electrically coupled.

BRIEF SUMMARY OF THE INVENTION

Various embodiments of the invention pertain to retention mechanisms, such as may be used in electrical connectors, that improve upon some or all of the above described deficiencies. Other embodiments of the invention pertain to methods of manufacturing such electronic connectors as well as electronic devices that include such connectors.

In view of the shortcomings in currently available electronic connectors described above, embodiments of the invention relate to improved connectors that allow for improved retention forces between an electrical tab and a connector receptacle, an increased normal force between the electrical contacts of the electrical tab and the receptacle, improved ease of use by providing a more consistent feel when a tab is inserted and extracted from its corresponding receptacle, and an increased life span of the device over many cycles of use. Although many aspects and features of the invention are described in relation to the electrical connectors depicted in the accompanying figures, it is appreciated that these features and aspects can be used in a variety of different applications and connector devices. Many other commonly used data connectors include standard USB and mini USB connectors, FireWire connectors, as well as many of the proprietary connectors used with common portable electronics.

In one aspect, the invention pertains to a retention latch mechanism for use in an electrical connector device having an electrical tab and a corresponding receptacle. Typically, such connectors, electrical contacts are formed on at least one surface of the tab and arranged in a symmetrical layout so that the contacts align with contacts of the connector receptacle. When the tab is fully inserted into the receptacle into a mated configuration, the individual contacts on the connector plug are electrically coupled to the corresponding electrical contacts within the receptacle.

In an exemplary embodiment, the retention latch mechanism is used in an electrical connector having corresponding retention features, for example, a connector receptacle having first and second retention features adapted to engage with corresponding third and fourth retention features on the outer surface of the insertable tab. In some embodiments, the retention latch mechanism comprises corresponding pairs of retention features, the retention features including one or more spring arms, and one or more backup springs adjacent the one or more spring arms that act as a stress reducing member.

In another aspect, the retention latch mechanism comprises an insertable tab having a pair of recessed retention features corresponding to a pair of spring arms that deflect laterally outward so as to be resiliently received within the recessed retention features so as to retain the insertable tab within the receptacle in a mated configuration. The mechanism further includes one or more backup springs positioned adjacent one or both of the spring arms along a surface facing away from the insertion axis along which the tab is inserted into the receptacle. The backup spring is configured and positioned so that outward lateral defection of the one or more spring arms as the tab is inserted into the receptacle contacts the backup spring so that the backup spring exerts a force against the spring arm to counter the force applied by the insertable tab.

In an exemplary embodiment, the backup spring includes any or all of bent portion of one or more brackets, a wire, a loop, a bent arm portion, or a complementary spring arm, or any combination thereof. The backup spring may include a portion of one or more brackets used to couple a receptacle housing to a device, or may include additional components coupled within the receptacle so as to provide stress reduction within the retention features therein.

In an exemplary embodiment, the backup spring includes one or more elastomeric members, often cylindrical elastomeric members, that are positionable adjacent the retention features through one or more corresponding holes in a housing defining the connector receptacle. Often, the mechanism includes a plurality of elastomeric members having differing spring constants such that the elastomeric members may be interchanged so as to adjust a retention force of the assembly. In some embodiments, the backup spring includes a dual backup spring defining a pair of backup spring arms that extend alongside a pair of retaining spring arms so as to distribute and reduce the stresses within the backup spring arms. Often, the dual back spring is integral with the retaining spring arms so as to further reduce the stresses within and improve the fatigue life of the retention mechanism.

In some embodiments, the connector may include a lubricating member that allows for self-lubrication of a retention mechanism that provides retention forces between an electrical connector plug and a connector receptacle. The mechanism includes a lubricating member that lubricates interfacing surfaces of the retention mechanism thereby ensuring that the retention mechanism operates properly, providing more consistent insertion and retention forces, and increasing the life span of the device over many cycles of use. Although many aspects and features of the invention are described in relation to the electrical connectors depicted in the accompanying figures, it is appreciated that these features and aspects can be used in a variety of different applications and connector devices. The invention is not limited to any particular type of connector and may be beneficial for a variety of commonly used data connectors as well as various proprietary connectors used in common portable electronics or other devices.

In some embodiments, the retention latch mechanism comprises corresponding pairs of retention features, the retention features including one or more spring arms, and one or more lubricating members adjacent the one or more spring arms that provide lubrication over the lifetime of the device. The lubricating member is configured to release lubricant on a surface of one or both of the retention features during insertion or retraction of the connector plug in the receptacle to lubricate a sliding interface between the retention features during insertion/retraction of the connector plug and receptacle. Any of the lubricating members described herein may also act as stress reducing members, such as a backup spring that contacts the one or more spring arms during insertion or retraction.

In one aspect, the retention latch mechanism comprises an insertable tab of a connector plug having a pair of recessed retention features corresponding to a pair of spring arms that deflect laterally outward during insertion to be resiliently received within the recessed retention features, thereby retaining the insertable connector plug within the receptacle in a mated configuration. The mechanism further includes one or more lubricating members that may be positioned adjacent one or both of the spring arms along a surface facing away from the insertion axis along which the connector plug tab is inserted into the receptacle. The lubricating member is configured and positioned so that outward lateral deflection of the one or more spring arms as the connector plug is inserted into the receptacle contacts the lubricating member so that the lubricating member releases a lubricant on surface of the spring arm to maintain a lubricated state and facilitate sliding of a retention feature of the spring arm against a corresponding retention feature of the tab. The lubricant may be released from the lubricating member upon contact with the lubricating member or as pressure is applied against the lubricating member by deflection of the spring arm. The lubricating member may comprise a porous material having pores, channels, and/or an internal well containing lubricant for release through the pores or channels. Any lubricant suitable for the desired application may be used. In some embodiments, release of the lubricant onto the retention feature will travel, such as along the surface, to the sliding interface between retention features, although the spring arm retention features may include a hole or groove to facilitate flow or transfer of the lubricant to the interface, such as through capillary action. In some embodiments, since the corresponding retention features are metal while various other components may include polymer or plastics, the lubricant may include any of a variety of lubricants, including but not limited to: silicone, molybdenum grease, Teflon, barium, lithium, petroleum, and graphite. The lubricant may be in a variety of forms, such as a liquid, paste, solid, powder, or any form suitable for slow-release from the lubricating member.

In an example embodiment, the lubricating member includes one or more elastomeric members adjacent the sliding interface of the retention features, often cylindrical elastomeric members so that the member can act as a backup spring. Lubricating members may be positionable through holes in a housing defining the connector receptacle so that the lubricating members can be easily assembled or so that the members can be replaced as needed as lubricant is exhausted. Alternatively, a lubricating member could be refilled through an access orifice at top of the member that can be accessed through the holes in the receptacle housing. In some embodiments, the lubricating member also acts as a backup spring, such as an elastomeric cylindrical member, to reduce the stresses in the spring arm as the arm is outwardly deflected during insertion/retraction. The mechanism may utilize a plurality of elastomeric members having differing spring constants such that the elastomeric members may be interchanged on as to adjust a retention force of the assembly.

Methods of providing retention of a tab within a receptacle are also provided herein. An exemplary method for retaining a tab within a receptacle in an electrical connector assembly includes: inserting a connector tab into the receptacle so as to contact an inward facing surface of each of a pair of spring arm retention features disposed within the receptacle; advancing the connector tab so as to displace each resilient arm laterally outward from an insertion axis along which the connector tab is inserted; contacting an outward facing surface of each arm with a corresponding backup spring member disposed within the receptacle; exerting a force with the backup spring member so as to reduce the stress within the arms; and mating the connector tab within the receptacle by advancing the connector tab until the spring arm retention features are resiliently received within corresponding recessed retaining features of the connector tab.

Another example method for retaining a connector plug within a receptacle in an electrical connector assembly includes: inserting a connector plug into the receptacle so as to contact an inward facing surface of each of a pair of spring arm retention features disposed within the receptacle; advancing the connector plug so as to displace each resilient arm laterally outward from an insertion axis along which the connector plug is inserted; contacting an outward facing surface of each arm with a corresponding lubricating member disposed within the receptacle so as to release a lubricant from the lubricating member onto a surface of each resilient arm and; mating the connector plug within the receptacle by advancing the connector plug until the spring arm retention features are slidably received within corresponding recessed retaining features of the connector tab, wherein the lubricant facilitates sliding of the interfacing surfaces of the retention features. The methods may further include contacting the lubricating member with the displaced resilient arm so as to reduce the stress within the arms during insertion.

To better understand the nature and advantages of the present invention, reference should be made to the following description and the accompanying figures. It is to be understood, however, that each of the figures is provided for the purpose of illustration only and is not intended as a definition of the limits of the scope of the present invention. In general, and unless it is evident to the contrary from the description, where elements in different figures use identical reference numbers, the elements are either identical or at least similar in function.

DETAILED DESCRIPTION OF THE INVENTION

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Figure 1:
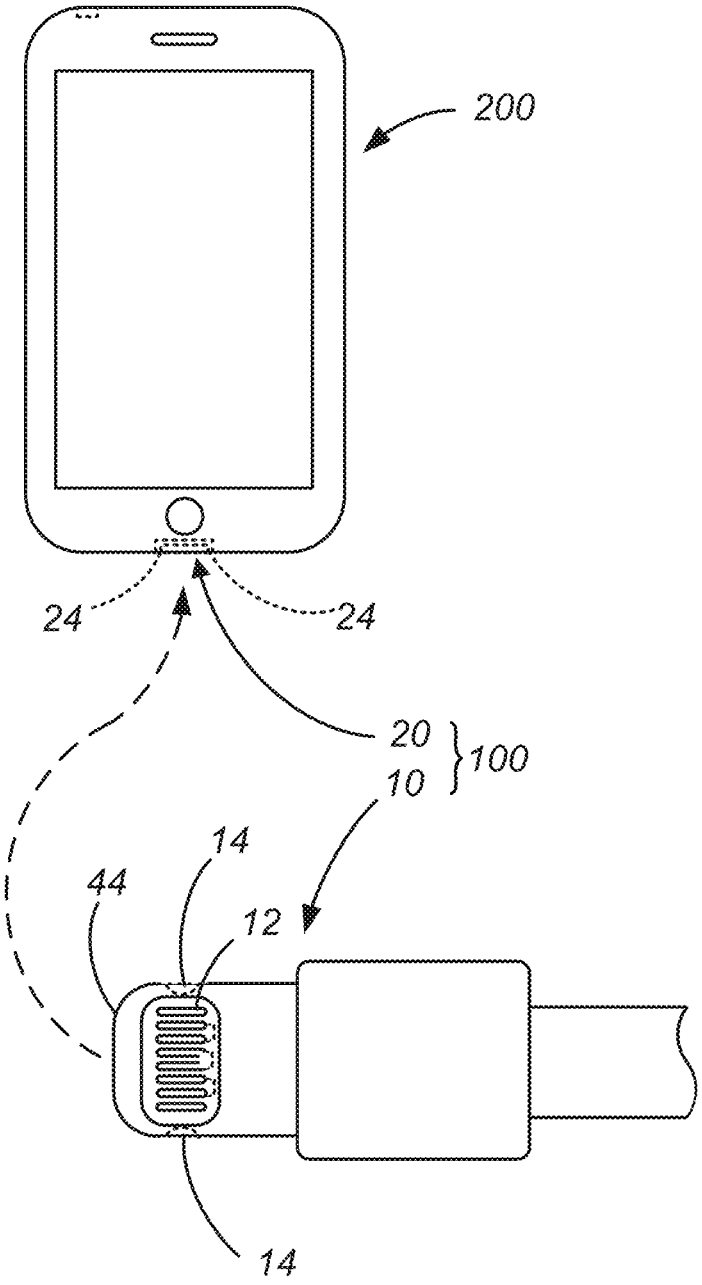
FIG. 1 shows an electrical connector device, in accordance with some embodiments.

In order to better appreciate and understand the present invention, reference is first made to FIG. 1 which is a simplified schematic representation of connector device 100 having a retention latch mechanism according to an embodiment of the invention. It is worth noting that the components in FIG. 1 are not drawn to scale. As shown in FIG. 1, connector device 100 includes a connector plug 10 compatible with a corresponding connector receptacle 20. The connector plug 10 may include multiple external electrical contacts 12 that can accommodate some or all of video, audio, data and control signals along with power and ground. The connector plug 10 includes a connector plug tab 44 that is insertable into connector receptacle 20 of a host device 200 that can be, for example, a portable media player. Each of the connector plug 10 and the connector receptacle 20 includes retention features 24 that engage when the connector plug 10 is fully, inserted within the connector receptacle 20 in a mated configuration, so as to aid in the alignment and electrical contact between the components and maintain the components in the mated configuration.

Figure 2A:
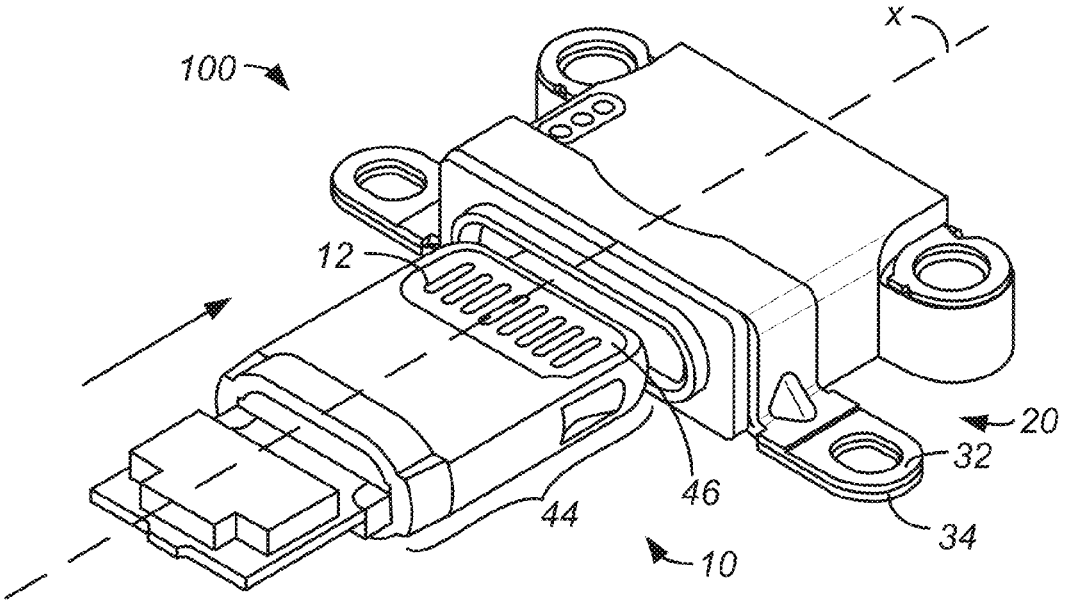
FIGS. 2A-2B show an example electrical connector device.
Figure 2B:
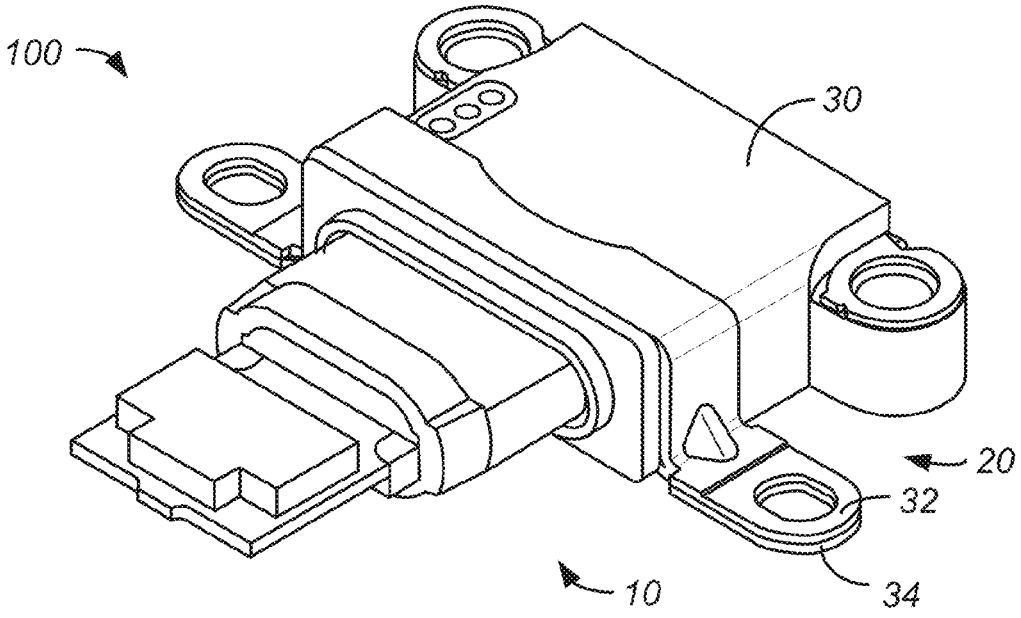

FIGS. 2A-2B illustrate an example connector plug 10 before and after insertion into a compatible connector receptacle 20, respectively. As shown in FIG. 2A, the connector plug 10 includes the connector plug tab 44 having electrical contact region 46 with a plurality of electrical contacts 12 for electrically coupling to corresponding electrical contacts (not shown) disposed inside the connector receptacle 20. The connector receptacle 20 is generally defined by a receptacle housing 30 that is attached to a surface or components on the interior of the device 200, such as by use of one or more brackets 32, 34. In the embodiment shown, the connector receptacle housing 30 is coupled within the device using an upper bracket 32 that extends over the upper portion of the receptacle housing 30 and a lower bracket 34 that extends underneath the receptacle housing 30. The end portions of each bracket 32 and 34 include holes for receiving a screw to facilitate mechanically coupling the receptacle housing 30 within the device 200. The connector plug 10 and connector receptacle 20 are connected by inserting the connector plug tab 44 along insertion axis x until the connector plug tab 44 is fully inserted into a mated configuration in which corresponding electrical contacts 12, 22 are electrically coupled, as shown in FIG. 2B.

Figure 3A:
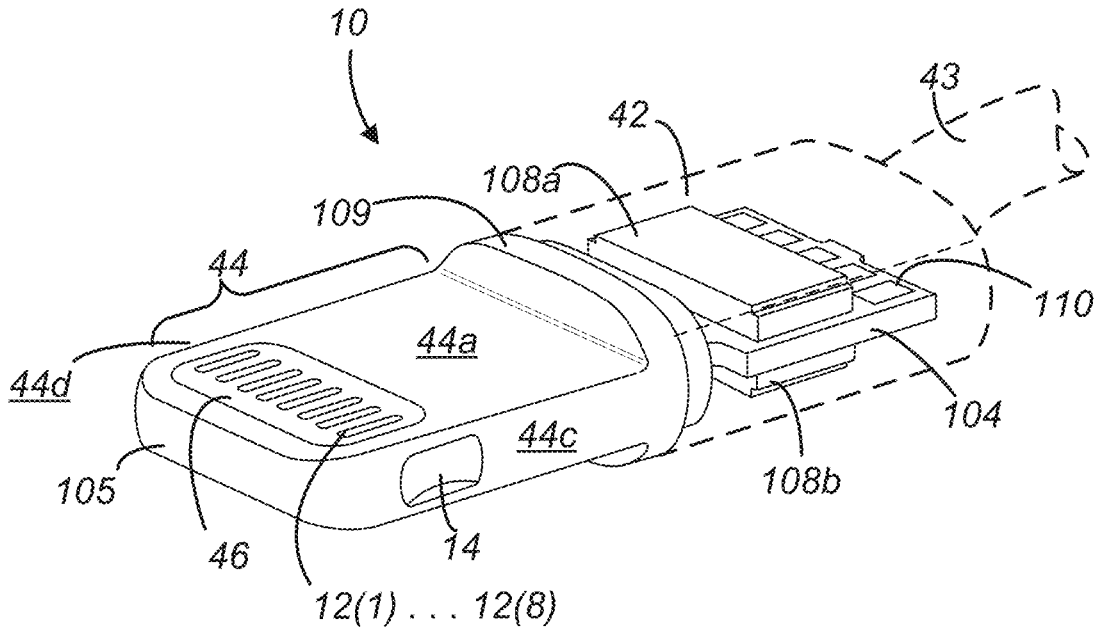
FIGS. 3A-3B show an alternate view of an exemplary connector tab and receptacle an electrical connector device.
Figure 3B:
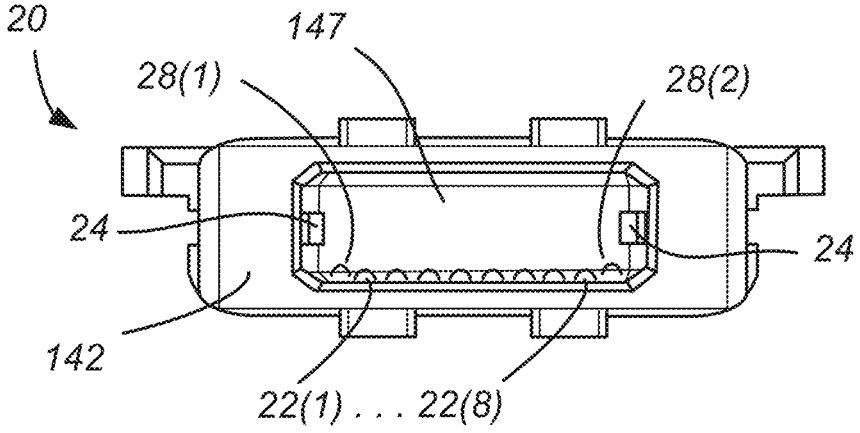
Figure 3C:
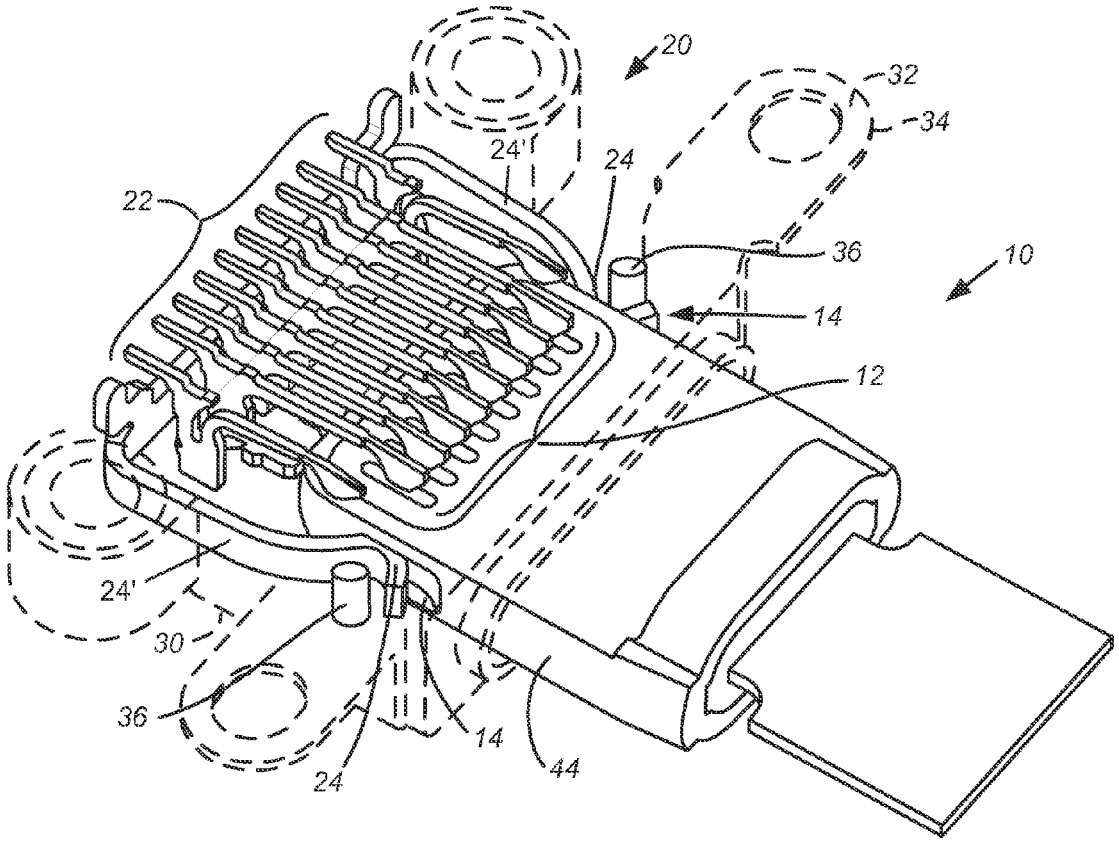
FIG. 3C shows an example connector plug having retention features and a self-lubricating backup spring.

FIGS. 3A-3C illustrate the connector plug tab 44 of the connector plug 10 and the connector receptacle 20 of FIGS. 2A-2B in further detail. FIG. 3A depicts the connector plug 10 having the insertable connector plug tab 44. The connector plug includes a connector plug body 42 and the connector plug tab 44 that extends longitudinally away from the body 42 in a direction parallel to the length of the connector plug 10. A cable 43 can optionally be attached to the body 42 at an end opposite of the connector plug tab 44. The body 42 is shown in transparent form so that certain internal components are visible. As shown, within the body 42 is a printed circuit board (PCB) 104 that includes bonding pads 110 and that extends into ground ring 105 between contact region 46 and an underside of the connector towards the distal tip of the connector plug 10. One or more integrated circuits (ICs), such as Application Specific Integrated Circuit (ASIC) chips 108*a* and 108*b*, can be operatively coupled to the PCB 104 to provide information regarding the connector plug 10 and any accessory or device that the connector plug 10 is part of and/or to perform specific functions, such as authentication, identification, contact configuration and current or power regulation.

In the above embodiment, the connector plug tab 44 is sized to be inserted into a corresponding connector receptacle 20 during a mating event and includes a first contact region 46 formed on a first major surface 44*a* extending from a distal tip of the connector plug to a spine 109 such that when the connector plug tab 44 is inserted into the connector receptacle, the spine abuts the receptacle housing 30 of the connector receptacle 20 or host device in which the connector receptacle 20 resides. In one particular embodiment, the connector plug tab 44 is 5.0 mm wide, 1.5 mm thick and has an insertion depth (the distance from the tip of connector plug tab 44 to spine 109) of 5.5 mm. In another embodiment, the connector plug tab 44 is 6.65 mm wide, 1.4 mm thick and has an insertable depth of 6.65 mm. The connector plug tab 44 may be made from a variety of materials including metal, dielectric or a combination thereof. For example, the connector plug tab 44 may be a ceramic base that has contacts printed directly on its outer surfaces or may include a frame made from an elastomeric material that includes flex circuits attached to the frame. In some embodiments, the connector plug tab 44 includes an exterior frame made primarily or exclusively from a metal, such as stainless steel, with a contact region 46 formed within an opening of the frame of the connector plug tab 44.

In this embodiment, the contact region 46 is centered between the opposing side surfaces 44*c* and 44*d*, and a plurality of external contacts 12(1) . . . 12(8) are shown formed on the top outer surface of the connector plug tab 44 within the contact region. The contacts can be raised, recessed or flush with the external surface of the connector plug tab 44 and positioned within the contact region such that when the connector plug tab 44 is inserted into a corresponding connector receptacle they can be electrically coupled to corresponding contacts in the connector receptacle. The contacts can be made from copper, nickel, brass, stainless steel, a metal alloy or any other appropriate conductive material or combination of conductive materials. In some embodiments, contacts are printed on surfaces 44*a* using techniques similar to those used to print contacts on printed circuit boards. The contacts can be stamped from a lead frame, positioned within contact regions 46 and surrounded by dielectric material.

In one aspect, the connector plug tab 44 includes one or more retention features 14 corresponding to one or more retention features 24 within the connector receptacle 20. For example, the retention features 14 of the connector plug tab 44 may include one or more indentations, recesses, or notches on each side of the connector plug tab 44 that engage with one or more corresponding retention features 24 within the receptacle, the corresponding retention features 24 extending or protruding toward the insertion axis along which the connector plug tab 44 is inserted so as to be resiliently received within the indentation, notch or recess within the sides of the connector plug tab 44. In one particular embodiment, the retention features 14 are formed as curved pockets or recesses in each of opposing side surfaces 44*c*, 44*d*, the shape and location of the retention features 14 corresponding to complementary retention features 24 in the connector receptacle 20 when in a mated configuration. In one embodiment the retention features 24 of the connector receptacle 20 include two opposing resilient arms 24' configured to be resiliently received within recesses of the retention features 14 once the connector plug 10 and connector receptacle 20 are properly aligned and mated. The engagement of these resilient retention features 24 of the connector receptacle 20 and the retention features 14 within the connector plug 10 can be seen in more detail in FIG. 3C.

In some embodiments, one or more ground contacts are formed on the connector plug tab 44, or may be included on an outer portion of the connector plug tab 44. In some embodiments, the one or more ground contacts are formed within and/or as part of a pocket, indentation, notch or similar recessed region formed on each of the side surfaces 44*c*, 44*d* (not shown in FIG. 3*a*), such that the retention features 14 may also act as the electrical ground for connector plug tab 44.

FIG. 3B depicts a connector receptacle 20 in accordance with some embodiments. The connector receptacle 20 includes a receptacle housing 30 that defines a receptacle cavity 147 and also includes side retention features 24 that engage with corresponding retention features 14 on the connector plug 10 to secure the connector plug 10 within cavity 147 once the connectors are mated. In some embodiments, the retention features 24 are resilient members or springs, often formed from an elongated arm that extends from a rear portion of the receptacle and extends toward the opening of cavity 147, such as shown in more detail in FIG. 3C. Retention features 24 can be made from an electrically conductive material, such as stainless steel, so that the feature can also function as a ground contact. The connector receptacle 20 can also include two contacts 28(1) and 28(2) that are positioned slightly behind the row of signal contacts and can be used to detect when the connector plug 10 is inserted within cavity 147 and/or when the connector plug 10 exits the cavity 147. When the connector plug tab 44 of the connector plug 10 is fully inserted within cavity 147 of the connector receptacle 20 during mating between the connector plug 10 and connector receptacle 20, each of contacts 12(1) . . . 12(8) from one of contact region 46 are physically coupled to one of contacts 22(1) . . . 22(8).

In this embodiment, the body 42 of the connector plug 10 is generally the portion of the connector 10 that a user will hold onto when inserting or removing connector 40 from a corresponding connector receptacle. The body 42 can be made out of a variety of materials and in some embodiments is made from a dielectric material, such as a thermoplastic polymer formed in an injection molding process. While not shown in FIG. 3A or 39, a portion of cable 43 and a portion of connector plug tab 44 may extend within and be enclosed by the body 42. Electrical contact to the contacts in contact region 46 can be made to individual wires in the cable 43 within the body 42. In some embodiments, the cable 43 includes a plurality of individual insulated wires that are soldered to bonding pads on a printed circuit board (PCB) housed within the body 42. Each bonding pad on the PCB is electrically coupled to a corresponding individual contact within one of contact region 46. Also, one or more integrated circuits (ICs) can be operatively coupled within the body 42 to the contacts within regions 46 to provide information regarding connector 40 and/or an accessory the connector is part of or to perform other specific functions as described in detail below.

In one aspect, the body 42 may be fabricated in any of a variety of suitable shapes, including a circular cross section, an oval cross section, or a rectangular cross section. In some embodiments, such as shown in FIG. 3A, the body 42 has a rectangular cross section with rounded or angled edges (referred to herein as a "generally rectangular" cross section), that generally matches in shape but is slightly larger than the cross section of the connector plug tab 44. In some embodiments, the body 42 and connector plug tab 44 of the connector plug 10 have the same cross sectional shape and have the same width and height (thickness). As one example, the body 42 and the connector plug tab 44 may combine to form a substantially flat, uniform connector where the body 42 and connector plug 10 seem as one. In still other embodiments, the cross section of the body 42 has a different shape than the cross section of the connector plug tab 44, for example, the body 42 may have curved upper and lower and/or curved side surfaces while the connector plug tab 44 is substantially flat.

FIG. 3C depicts the connector plug tab 44 of the connector plug 10 fully inserted into the connector receptacle 20 (the receptacle housing 30 is shown as transparent so that certain internal components are visible). As can be seen, when the connector plug tab 44 is fully inserted into the connector receptacle 20, the electrical contacts 22 engage with and electrically couple with the group of electrical contacts 12 on the top surface of the connector plug 10. Also, when the connector plug tab 44 is fully inserted and properly positioned within the connector receptacle 20 in the mated configuration, the corresponding retention features on each of the components are engaged, which helps ensure proper alignment of the components as well as retaining the connector plug 10 within the connector receptacle 20, as shown in FIG. 3C. As in some embodiments, the retention features 24 of the connector receptacle 20 are two spring-like resilient arms 24' that extend from a rear portion of the receptacle housing 30 along each side of the receptacle housing 30 toward the opening of the cavity 147 in which the connector plug tab 44 is inserted. The lubricating members 36 are disposed adjacent an outer facing side of the retention features 24 so that when the resilient arms 24' defining the retention features 24 are displaced laterally outward during insertion, the resilient arms 24' contact the lubricating members 36 and press against the members thereby releasing a lubricant onto the retention features 24. The lubricating members 36 are configured and positioned so that when engaged, the lubricant is released from the lubricating members 36 to a sliding interfacing surface of the retention features 24, such as through surface contact, capillary action, or movement of the components during cycling. For example, in the case of a paste or liquid lubricant, the lubricant may flow through surface contact over the retention features 24 to the interfacing surface, or in the case of a solid, such as a powdered PTFE, the lubricant would fall or travel as air-borne dust to deposit on the adjacent interfacing surfaces of the retention features 24. In some embodiments, retention features 24 of the connector receptacle 20 may include a spring arm having a hole therethrough or groove near the sliding interface to facilitate transfer of lubricant along the spring arm to the sliding interface.

As shown in FIGS. 3A-3C, the first and second retention features 14 may be formed on the opposing sides of connector plug tab 44 within ground ring 105 and are adapted to engage with one or more corresponding features within the connector receptacle 20 to secure the connectors together when mated. In some embodiments, the corresponding retention features 14 are semi-circular indentations in the side surfaces of the connector plug tab 44. The corresponding retention features 14 may be widely varied and may include angled indentations or notches, pockets that are formed only at the side surfaces and do not extend to the top surface 44*a* or opposing bottom surface. In one aspect, the resilient arms 24' defining the retention features 24 of the receptacle connector 20 comprises a tip or an angled or curved surface (such as the inwardly curved portion shown in FIGS. 3A-3C) that slides into and fits within the recessed retention features 14 of the connector plug 10.

In some embodiments, the retention features 24 of the connector receptacle 20 are a curved portion of the resilient arms 24' designed so that the curved portions that engage with the corresponding retention features 14 of the connector plug 10 are positioned near the opening of the cavity 147 in which connector plug tab 44 is inserted. This may help better secure the connector sideways when it is in an engaged position within the connector receptacle 20. It is appreciated however, that either of the retention features could be located or positioned in any suitable location so that when engaged the retention features help retain the components in the proper alignment in the mated configuration.

Figure 4:
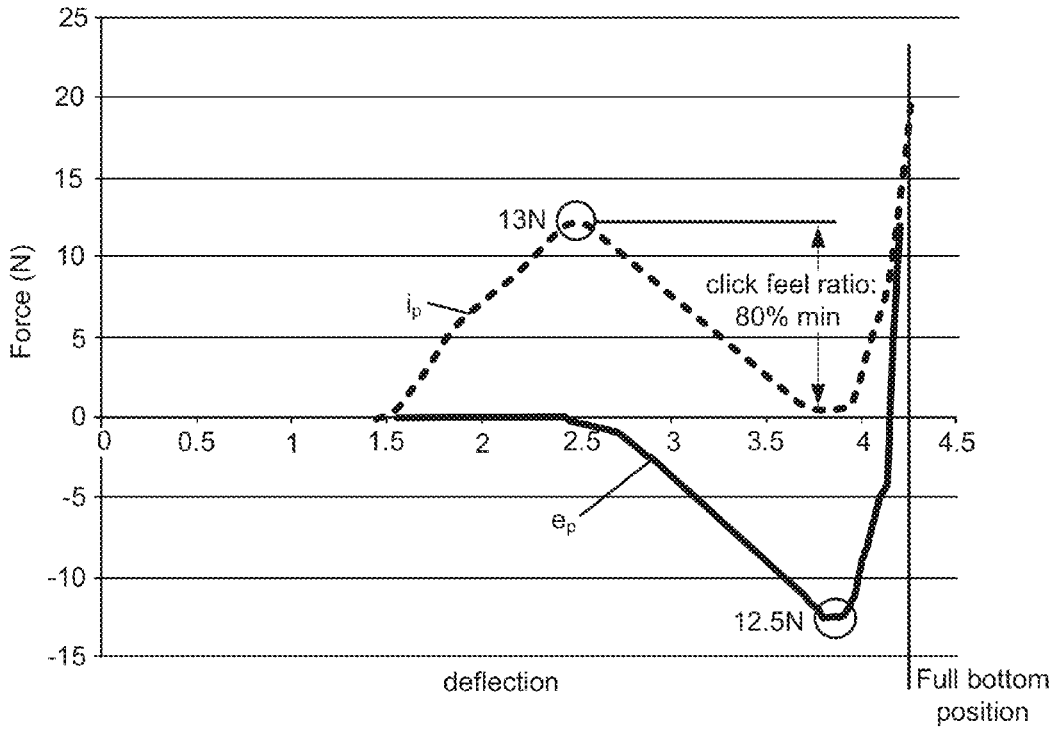
FIG. 4 shows an insertion and extraction performance profile relating to testing of an example electrical connector device.

In an example embodiment, the angled and curved surfaces of corresponding retention features of the connector plug tab 44 and the connector receptacle 20 are configured so as to provide a desired insertion force and extraction force, such as the forces depicted in the insertion/extraction force profile shown in FIG. 4. The retention features of each of the connector plug 10 and the connector receptacle 20 can be designed or modified, such as by increasing or decreasing the curvature of one or both features or by changing the spring force exerted by the resilient arm, so as to provide desired insertion and extraction forces. In some embodiments, the force required to extract the connector plug tab 44 from the connector receptacle 20 is greater than the force required to insert the connector plug tab 44 into the connector receptacle 20. This aspect increases ease of use by allowing a user to easily insert the connector plug tab 44 of the connector plug 10 into the connector receptacle 20, and recognize when the connector plug tab 44 is properly positioned due to the tactile response resulting from engagement of the corresponding retention features, and further prevents inadvertent or accidental withdrawal of the connector plug 10 from the connector receptacle 20. As described above, in embodiments utilizing features similar to those in FIGS. 3A-3C, the insertion and extraction forces may vary according to a variety of factors that may include the angle or curvature of the recess and/or the corresponding resilient arm, as well as the material and width of the resilient arm itself.

Another factor affecting the force profile is the friction between the sliding, interfacing surfaces of corresponding retention features 14, 24. While the retention features may be configured to provide a desired insertion/retraction force profile, the force profile of corresponding retention features may differ between a lubricated state and anon-lubricated state. Thus, maintaining a lubricated state between corresponding retention features by using a lubricating member provides for more consistent insertion/retraction forces over many cycles of use.

Figure 5A:
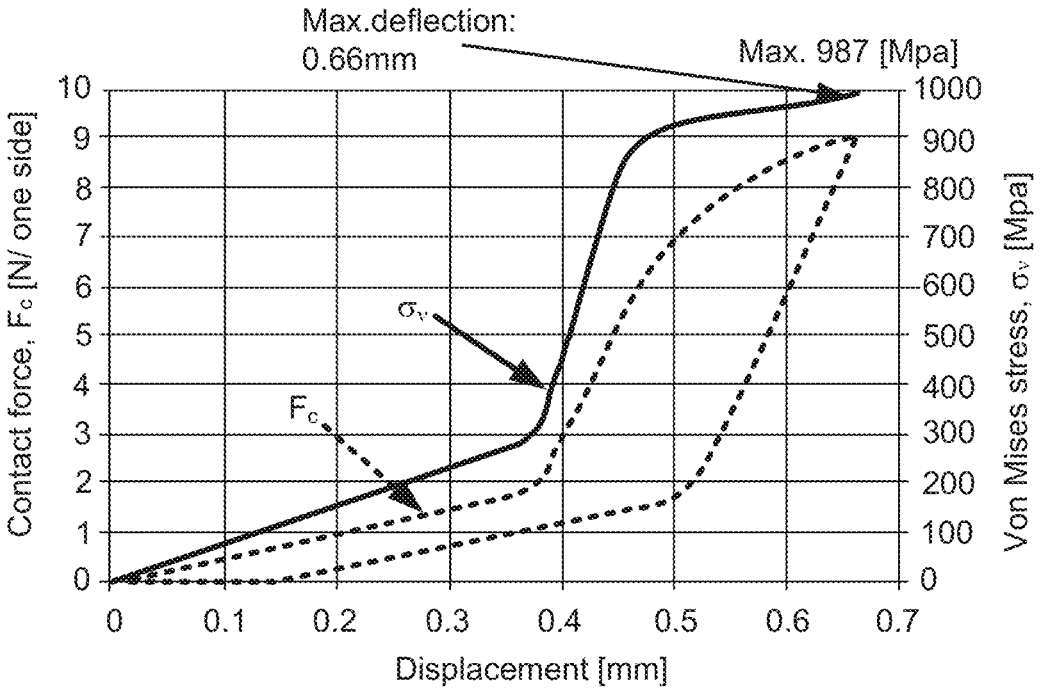
FIGS. 5A-5B show the contact forces and stresses associated with use of many electrical connector devices.
Figure 5B:
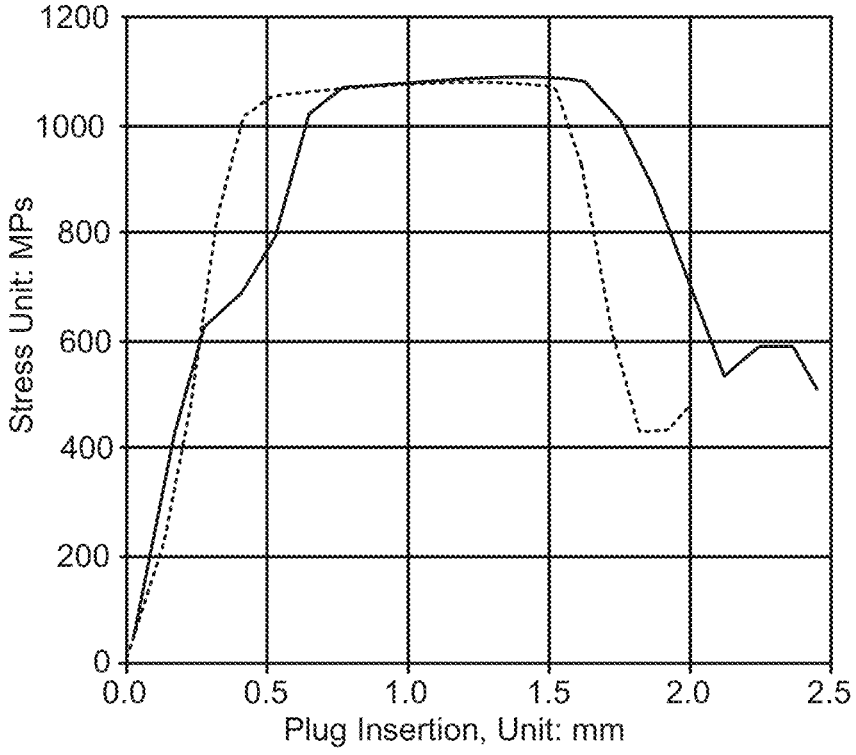

While the retention features described above offer significant advantages in many connector designs, these features may present additional challenges. For example, in an embodiment where the receptacle includes retention features comprising a pair of resilient arms extending on opposite sides of the receptacle, the lateral movement of the resilient arms while the connector plug is being inserted may result in substantial contact forces and stresses within the resilient arms or springs. Repeated cycling of these stresses and contact forces over many cycles of use may ultimately cause material failure or fatigue failure, resulting in cracking or breaking of the resilient arm. An example of typical contact forces and stresses associated with insertion and retraction of many connector devices using retention features similar to those described above is shown in FIGS. 5A-5B. As can be seen in FIG. 5A, in some connector devices, the contact forces can cause lateral deflection of a resilient arm retention feature to exceed a maximum allowable deflection, which would result in material failure.

Examples of material properties associated with materials commonly used in connector assemblies using in accordance with some embodiments are presented in Table 1 below. In an example embodiment, 301 3/4h Stainless Steel is used for the spring arms retention features due to its high stiffness and forming ability. In some designs, however, material failure was noted after cycles of use ranging from 2,000 to 7,000 cycles. In some embodiments, use of a stress reducing member, such as backup springs, allow for an example connector assembly having a retention latch to operate for over 10,000 cycles of use without material failure. In some embodiments, the lubricating member is integral with the backup spring, although it is appreciated that a lubricating member may be used in combination with one or more backup springs, such as any of the example backup springs referred to above. The use and advantages of a backup spring are described in more detail below.

TABLE 1

Material Properties for Selected Spring Arm Materials

| | | E | Tensile Strength | Yield Strength | Fatigue/Endurance Limit |
|---|---|---|---|---|---|
| 301¾ h | L-direction | 193 GPa | 1250 MPa | 950 MPa | 850 MPa |
| 301¾ h | C-direction | 193 GPa | 1180 MPa | 850 MPa | 750 MPa |
| 301 h | L-direction | 193 GPa | 1400 MPa | 1250 MPa | 1000 MPa |
| 301 h | C-direction | 193 GPa | no data | no data | 850 MPa |

Figure 6A:
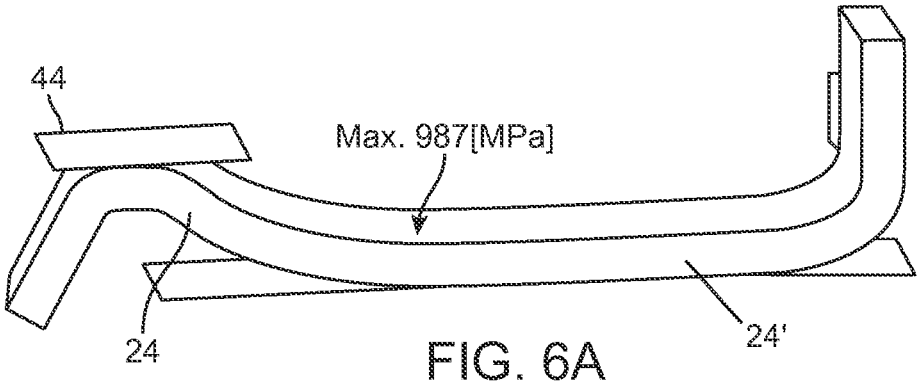
FIGS. 6A-6B show the locations of contact forces and stresses as seen in many electrical connector devices.
Figure 6B:
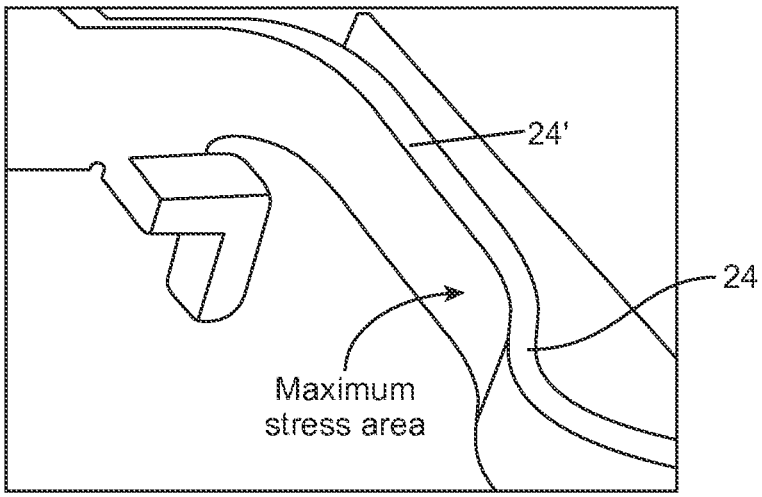

In some connector designs, the lateral outward displacement of the resilient arm retention feature may cause the resilient arm to contact a portion of the receptacle housing or other such component, which further increases the forces and stresses within the resilient arm making material failure more likely. Examples of such forces and stresses are illustrated in the stress models of the resilient arms 24' and associated retention features 24 shown in FIGS. 6A-6B. Although the strength of the material can be modified by using a thicker or different material, generally such modifications affect the flexibility of the arm, which may result in an undesirable insertion/extraction profile. In an example embodiment, the connector includes a resilient stress reducing member, which reduces the stresses and contact forces within the resilient arm without reducing the spring force of the arm when mated. Thus, in some embodiments, the use of one or more stress reducing members, such as a backup spring, allows for a desirable insertion/extraction profile using the above described retention features without the aforementioned drawbacks of many designs relating to material failure.

In some embodiments using the resilient arms 24' described above, the connector receptacle 20 includes a backup spring as a stress reducing member. The mechanism may utilize a lubricating member 60 disposed adjacent a resilient arms 24' as one such stress reducing member, such as shown for example in FIG. 16B. The backup spring can be positioned adjacent the angled or curved retaining portion that is received within the corresponding recess of the connector plug tab 44 to directly counter the forces applied by the connector plug tab 44 during insertion, although in some embodiments, the backup spring may be placed in other locations, such as closer to a mid-point of the resilient arm 24' or closer to a rear portion of the resilient arm. Generally, the stress reducing member is positioned adjacent a side or outer surface of the resilient arm which faces away from the insertion axis along which the connector plug 10 is inserted into the receptacle cavity 147 to allow the inner surface of the resilient arm to contact connector plug 10 during insertion and be received within the recess of the connector plug tab 44. As the resilient arms 24' are displaced laterally outward during insertion of the connector tab, the resilient arms contact and press against the stress reducing resilient member which helps relieve some of the forces exerted against the resilient arms by the connector plug and the stresses within.

In some embodiments, such as shown in FIGS. 5A-8C, each resilient stress reducing member 36 is positioned so that there is a gap (g) between the member and the resilient arm 24' defining the retention features 24 before the connector plug tab 44 is inserted such that inserting the connector plug tab 44 displaces the resilient arms 24' defining the retention features 24 laterally outward closing the gaps. In some corresponding embodiments, similar gaps may be formed as the retention features 24 of the resilient arms 24' are received within the retention features 14 in the mated configuration (the gap being smaller than the gap prior to insertion), or alternatively the retention features and stress reducing member 36 may remain in contact when in the fully mated configuration. In some embodiments, designing these features so that they remain in contact in the mated configuration may be useful when the lubricating member 36 is used as a backup spring to provide additional retention force in the mated configuration and/or may be used as a ground path for the ground ring. In other embodiments, the backup spring may be in contact with the resilient arms 24' before and/or after insertion of the connector plug tab 44 into the connector receptacle 20.

Figure 7A:
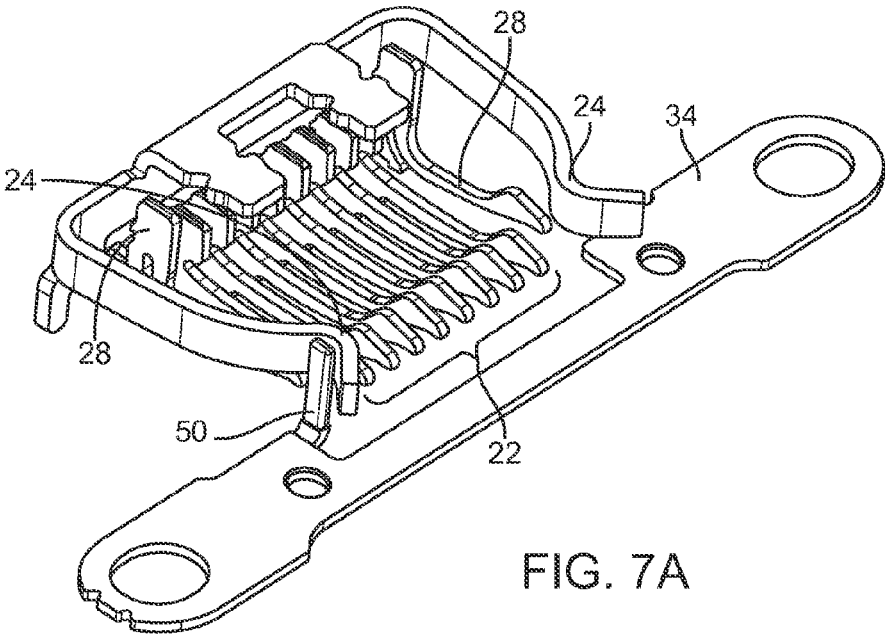
FIGS. 7A-7B show an example electrical connector receptacle of an electrical connector device.
Figure 7B:
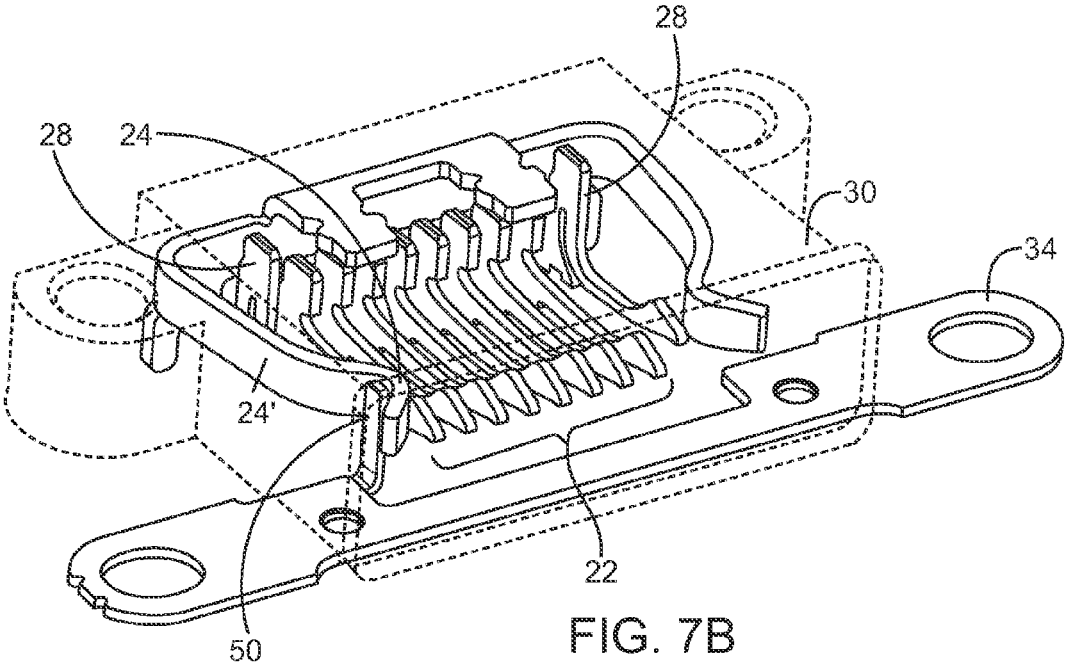

In some embodiments, the stress reducing member is formed by a portion of the housing and/or the brackets that secure the receptacle housing within the device. FIGS. 7A-7B illustrate an embodiment in which the stress reducing member is formed by a tab-like portion 50 of the lower bracket 34. The tab-like portion may be formed during fabrication of the bracket by bending a relatively small portion of the bracket away from the remainder of the bracket. Bending a small tab-like portion upward, typically perpendicular to the rest of the bracket, allows the tab-like portion to function as a spring or resilient member. When the bracket 34 is assembled with the receptacle housing 30 having the electrical contacts 22 and the resilient arm retention features 24 disposed within, the tab-like portion is disposed adjacent the retention features 24 typically adjacent the angled or curved portion that is received with the corresponding recess of the connector tab. Although only one stress reducing member 50 is shown in the embodiment in FIGS. 7A-7B, typically one is placed adjacent an outer facing surface of each of a pair of resilient arms disposed within and extending along opposing sides of the receptacle housing 30.

Figure 8A:
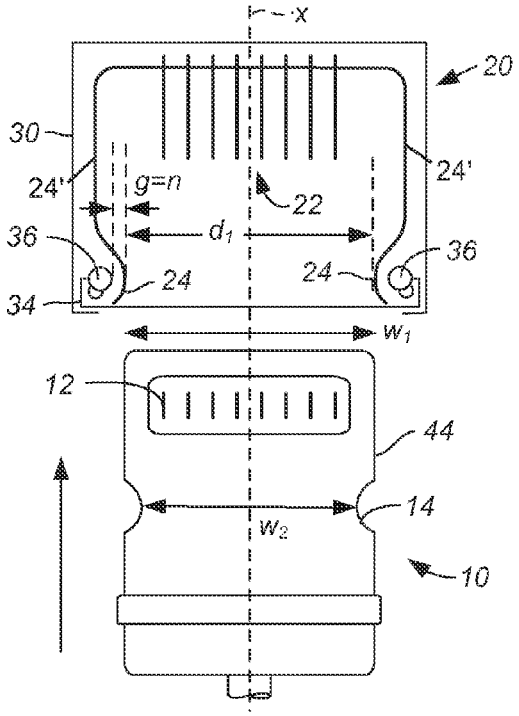
FIGS. 8A-8C illustrate sequential cross-sections along an insertion plane showing the insertion of an example connector plug into a connector receptacle.
Figure 8B:
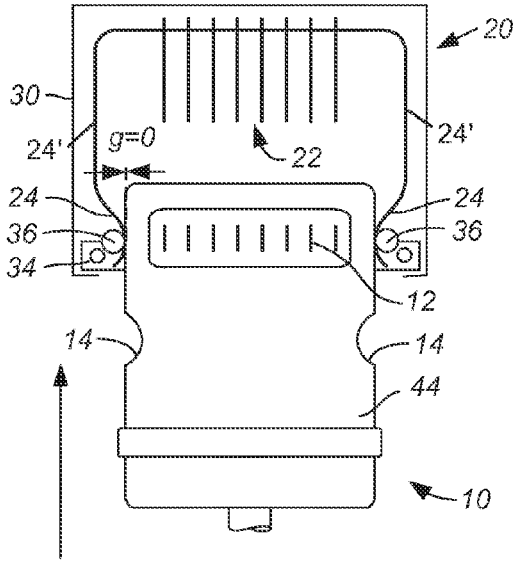
Figure 8C:
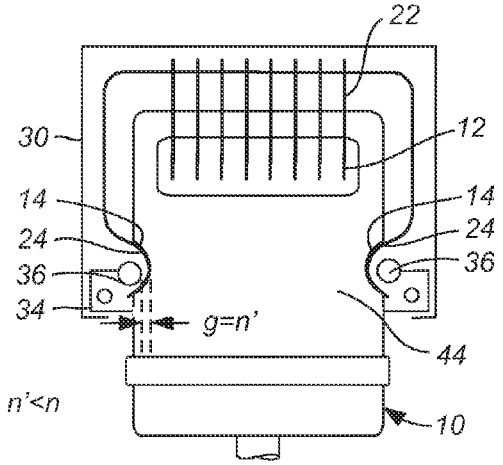

The use of a resilient stress reducing member within a retention mechanism can be further understood by referring to FIGS. 8A-8C, which sequentially illustrates the insertion of a connector tab into a receptacle having such resilient stress reducing members. In FIG. 8A, an exemplary embodiment having a resilient stress reducing member, such as described in FIGS. 7A-7B, is shown prior to insertion of the connector plug 10. As can be seen, the width of the front portion of the connector plug tab 44 (w1) is wider than the distance between the curved portions of the resilient arms 24' defining the retention features 24 (d1) of the receptacle so that insertion of the connector plug tab 44 displaces the resilient arms 24' laterally outward toward the backup springs. Additionally, the distance between the backup springs is also less than w1 so that when insertion of the connector plug tab 44 laterally displaces the resilient arms 24', each arm is contacted by the corresponding adjacent backup spring thereby reducing the stresses within each resilient arm. It can also be seen that the width (w2) between the recessed retention features 14 is greater than the distance d1, so that when the connector plug 10 and receptacle 20 are in the mated configuration, the spring arms exert a force on the connector plug tab 44 toward the insertion axis x. In the illustrated embodiment, the backup spring is configured so that there is a relatively small gap (g). The magnitude of the gap in this configuration (n) may be relatively small, such as a 0.1 mm to 4 mm gap.

When the resilient stress reducing member 50 is a lubricating member, such as the lubricating members 60 or 66 in FIGS. 15A-17B, contact of the retention features 24 with lubricating members 60 releases lubricant onto the resilient arms so as to lubricate engaged surfaces of the retention mechanism, such as that shown in FIG. 3C. Pressure of the resilient arms against the lubricating members 60 causes lubricant, whether a liquid, paste or powder, to be released from the lubricating member 60 onto the adjacent spring arm defining retention features 24. When contacted, the lubricating members 60 may also act as backup springs countering the force applied by the connector plug tab 44 and transferring this force along the bracket 34. As seen here, lubricating members 60 is included on the outside of each of a pair of spring arms. Using opposing spring arms, each having a lubricating member, is advantageous as this lubricates each side to maintain a lubricated state and further distributes the stresses to provide a more uniform retention force in the mated configuration. Generally, the force of the lubricating members 60 exerted inward against the outer facing surface of the resilient arms is proportional to the outward distance by which the retention features 24 is displaced. This aspect also provides a consistent pressure against the lubricating members 60 in each cycle of use so that lubricant is released in a consistent manner.

FIG. 8B illustrates insertion of the leading portion of the connector plug tab 44 into the receptacle 20 between the resilient spring arms 24' which displaces each of the resilient spring arms 24' laterally outward away from the insertion axis (x) and against the backup spring. The backup spring counters the force applied by the connector plug tab 44 and transfers this force along the bracket 34. In an exemplary embodiment, the backup spring is included on the outside of each of a pair of spring arms. Using opposing resilient arms 24', each having a backup spring, is advantageous as this further distributes the stresses as well as provides a more uniform retention force in the mated configuration. Additionally, utilizing a pair of spring arms defining retention features 24 as well as a pair of backup springs 36 configured so that the forces applied to such springs are in opposing direction is further advantageous as these opposing forces are can be resolved within the U-shaped metal bracket comprising the resilient arms 24' and within the upper and/or lower bracket comprising the backup springs. Generally, the force of the backup springs exerted inward against the outer facing surface of the resilient arms 24' is proportional to the outward distance by which the backup spring 36 is displaced. This aspect helps keep the contact forces and stresses within the resilient arms 24' below the threshold and/or helps keep the lateral displacement of the resilient arms 24' within a desired range so as to avoid failure or interference with adjacent components.

FIG. 8C illustrates the connector plug 10 fully inserted within the connector receptacle 20 within the mated configuration, each of the electrical contacts 12 of the connector plug 10 electrically coupled with the electrical contacts 22 of the connector receptacle 20. As can be seen, the curved portions of the spring arm retention features 24 are engaged within the recessed retention features 14 of the connector plug 10 and the distance between the spring arms is w2, such that the spring arms are outwardly displaced in the mated configuration so as to provide a retaining force against the sides of the connector plug tab 44 as well as to ensure electrical contact so that the resilient arms 24' may function as a ground path for the ground ring of the connector plug 10. In some embodiments, there may be a gap between each of the backup spring 36 or the lubricating members 60 and the associated resilient arms 24' defining the retention features 24 so that the inwardly directed retention force between the resilient arms 24' and the connector plug tab 44 is proportionally related to the outward displacement of the resilient arms 24' in the mated configuration. In such embodiments, the magnitude (n') of the gap in this configuration would be less than the magnitude (n') of the gap before insertion. In some embodiments, the backup spring 36 may be configured so that contact between the backup spring 36 and the resilient arms 24' is maintained in the mated configuration, such that the inwardly directed retention force on the connector plug tab 44 is a proportionally related to the displacement and spring constant of each of the backup spring 36 and the resilient arms 24'. This aspect may be useful in that the retention force may be adjusted by utilizing different brackets 32, 34 rather than modifying the resilient arms. This may also be useful as this may provide an additional ground path through the brackets to which the backup spring 36 may be connected. In a configuration using a lubricating member 60 as the backup spring 36, since the lubricating member is only contacted during mid-insertion, there being a gap when the connector is fully mated or fully separated, the lubricant is only released during insertion or retraction of the connector plug from the connector receptacle.

Figure 9A:
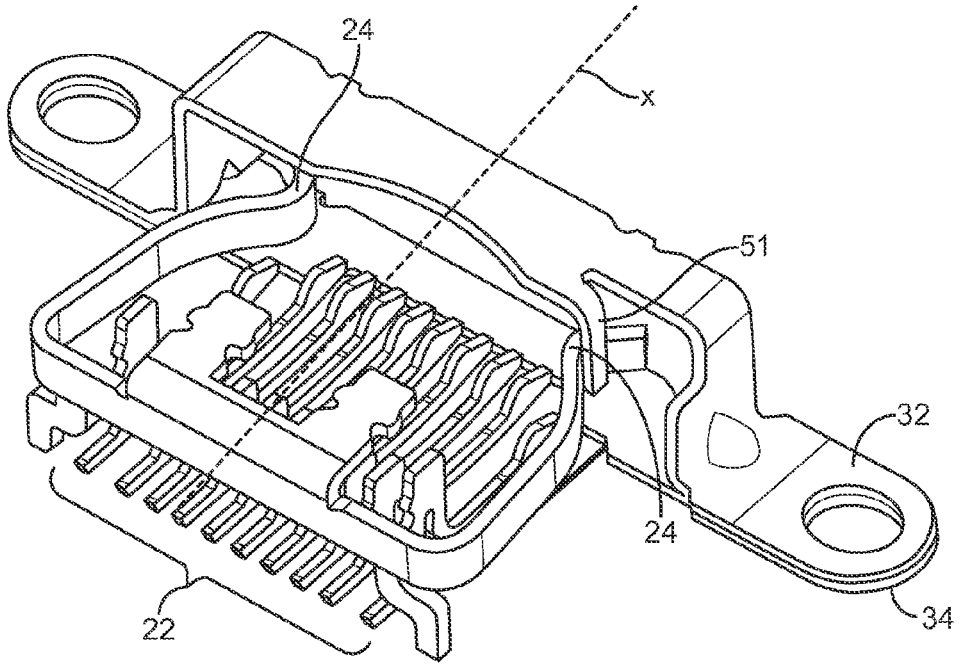
FIGS. 9A-9C show an example electrical connector receptacle of an electrical connector device.
Figure 9B:
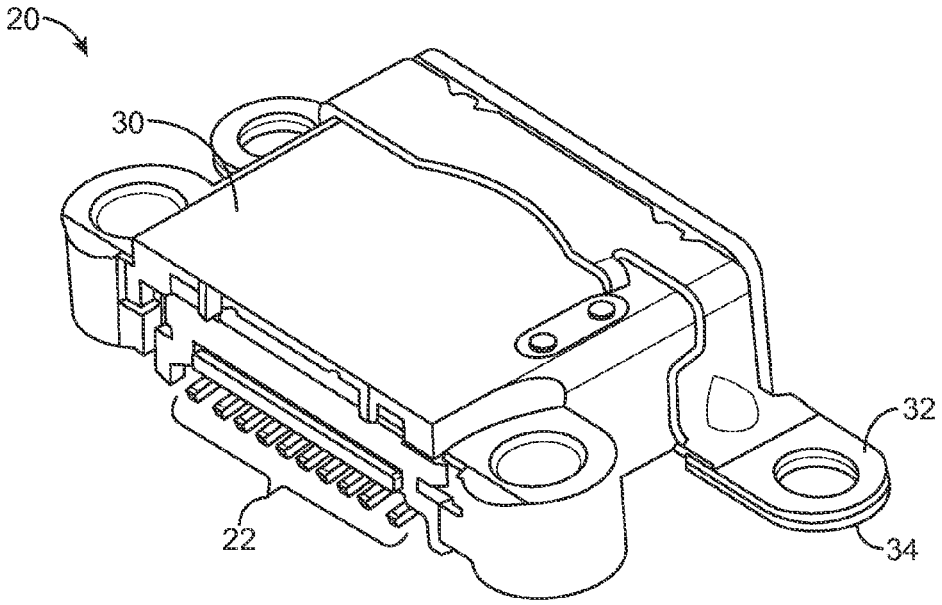
Figure 9C:
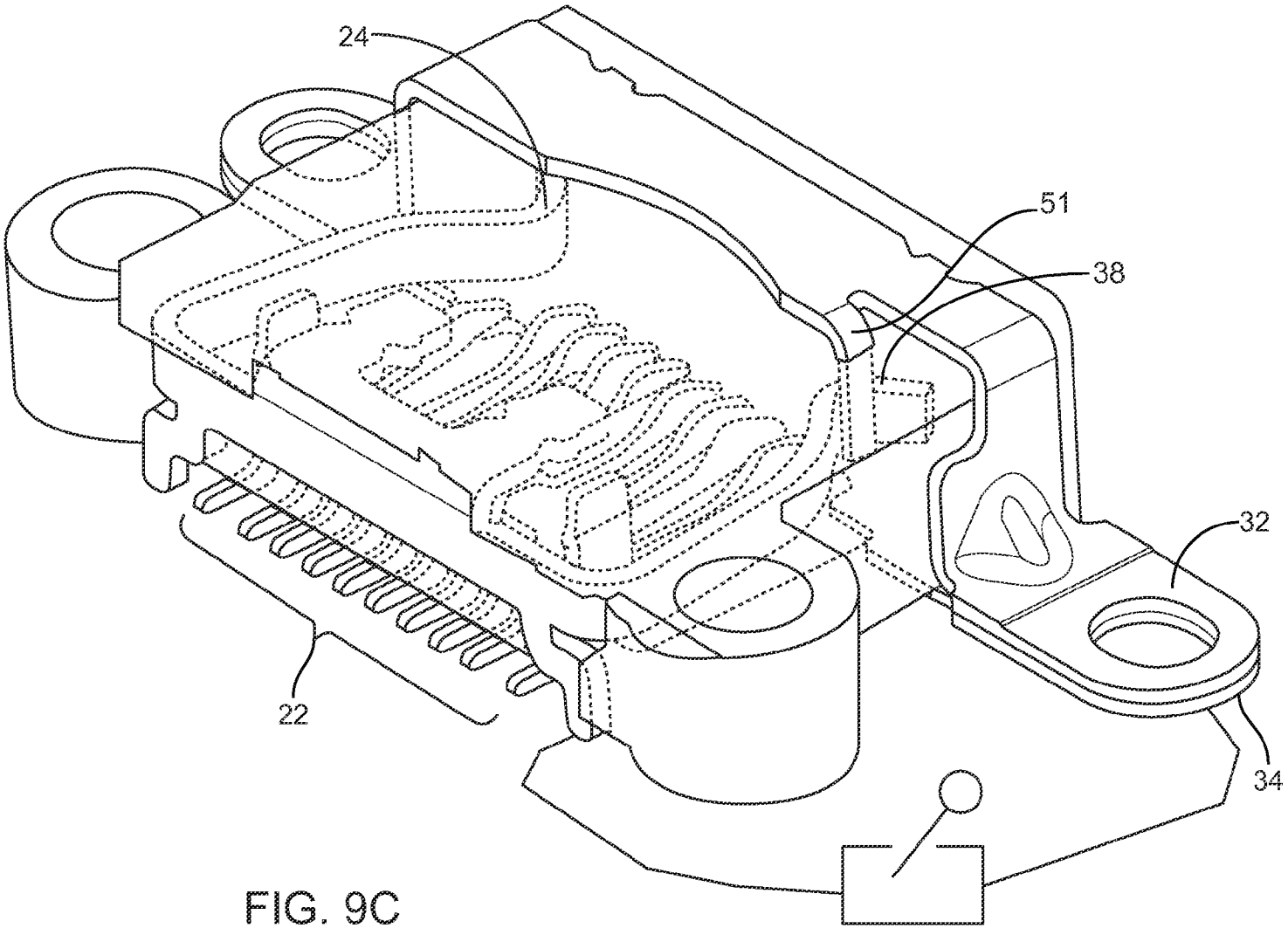

FIGS. 9A-9C illustrate an alternative embodiment, wherein the stress reducing member is a backup spring 51 formed from the upper bracket 32. The upper bracket 32 may be fabricated with an arm that extends toward the rear portion of the receptacle housing 30 and down through a hole in the top surface of the receptacle housing 30 (indicated by the arrow) so as to extend along a side of the curved portion of the resilient arm facing away from the insertion axis x. Although this backup spring 51 is depicted only on one side in FIGS. 9A-9B, typically the backup spring 51 would be included on each of the spring arms so as to more evenly distribute forces and reduce stresses during insertion of the connector plug tab 44. FIG. 9C graphically depicts a circuit schematic overlayed an exemplary device to show how the backup spring 51 may be used as a ground path for the connector receptacle 20, or alternatively, how the circuit may be used to detect when the backup spring is contacting resilient arms, which may be particularly useful in optimizing or configuring the backup spring to provide a desired force.

Figure 10:
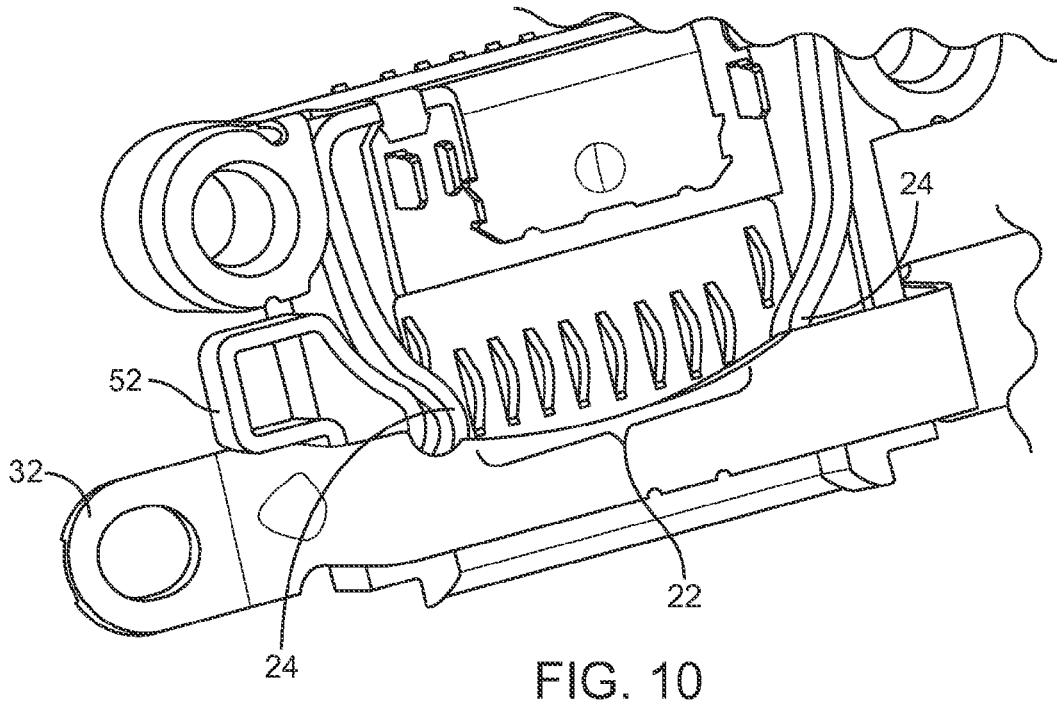
FIGS. 10-14 show an example electrical connector receptacle of an electrical connector device.

FIG. 10 illustrates an alternative embodiment, wherein the backup spring comprises a loop 52 extending along a plane that is parallel to the plane along which the connector plug tab 44 is inserted. The loop 52 may be configured in a variety of differing shapes, such as that shown in FIG. 10 designed so as to complement the curved portion of the resilient arms. Typically, as the spring arms extend outward, the loop 52 compresses thereby exerting an inwardly directed force on the spring arms to counter the forces from the connector plug tab 44 during insertion and reduce the stress within the spring arms to the desired levels.

Figure 11:
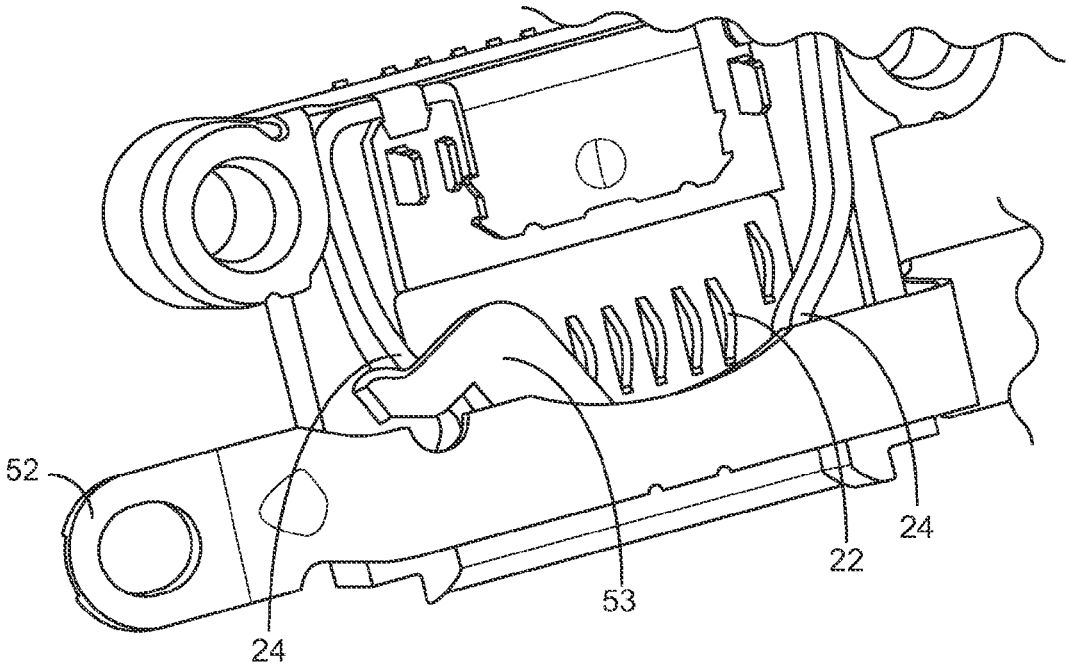

FIG. 11 illustrates an alternative embodiment, wherein the backup spring comprises an upper bracket extension 53 that extends a distance toward the rear portion of the receptacle 20 before extending down along an outer facing side of the spring arm. In this embodiment, the backup spring 53 is positioned adjacent a portion of the resilient arm 24' preceding the retention features 24 that engages the recessed retention features 14 of the tab 44.

Figure 12A:
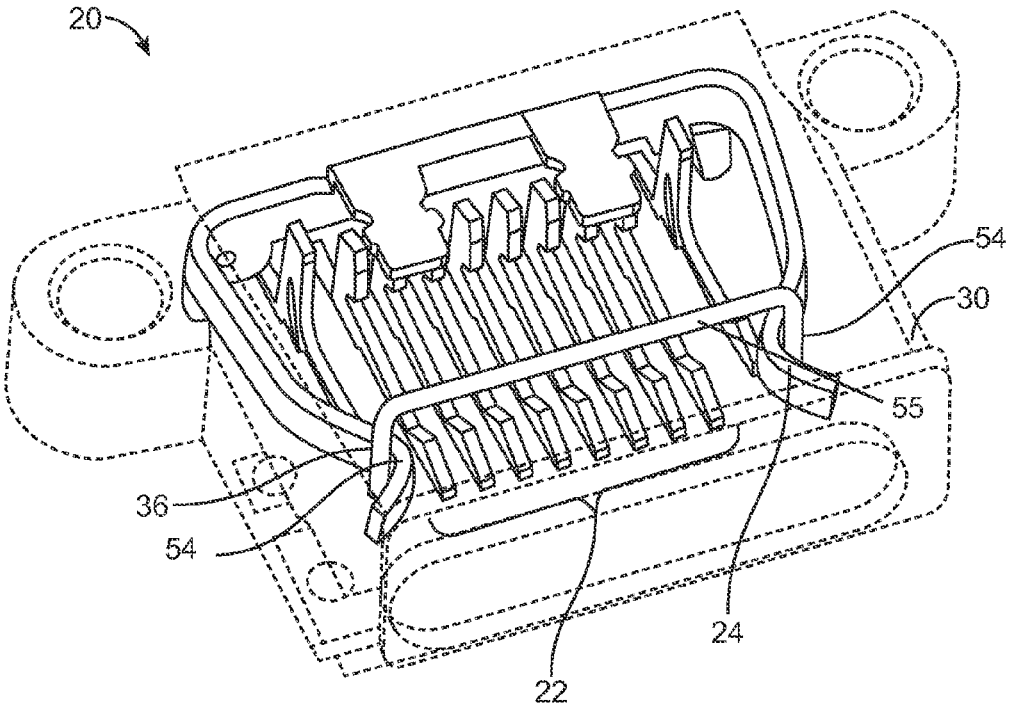
Figure 12B:
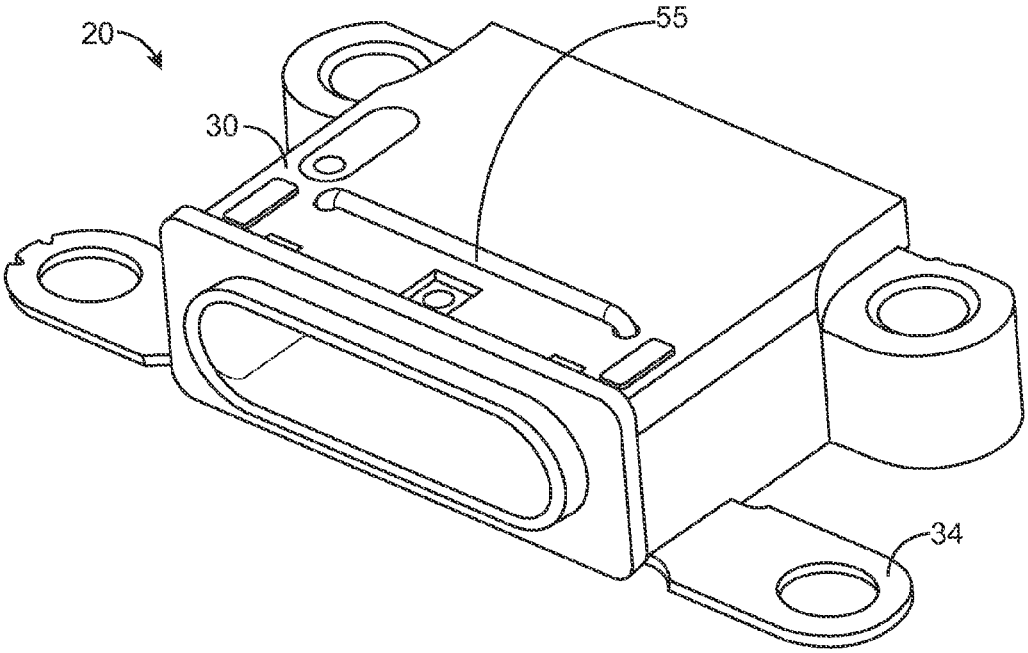

FIGS. 12A-12B illustrate an alternative embodiment, wherein the backup spring comprises bent end portions 54 of a wire 55, such as standard 0.3 mm piano wire or music wire. The end portions 54 are bent at an angle, typically about 90 degrees, and inserted through corresponding holes in the top surface of the receptacle housing 30 so as to extend through the housing 30 and alongside the outer facing surface of the spring arms. Generally, the bent end portions 54 are positioned adjacent the curved portions that are received within the corresponding recessed retention features 14, such as shown in FIG. 12A (the receptacle housing 30 is shown as transparent so that certain internal components are visible). This configuration is advantageous in that modification of the brackets 32, 34, such that existing connector assemblies can be easily retrofitted with the bent end portion 54 as described above so as to reduce stresses within the resilient arms and prolong the useful life of the connector assembly.

Figure 13:
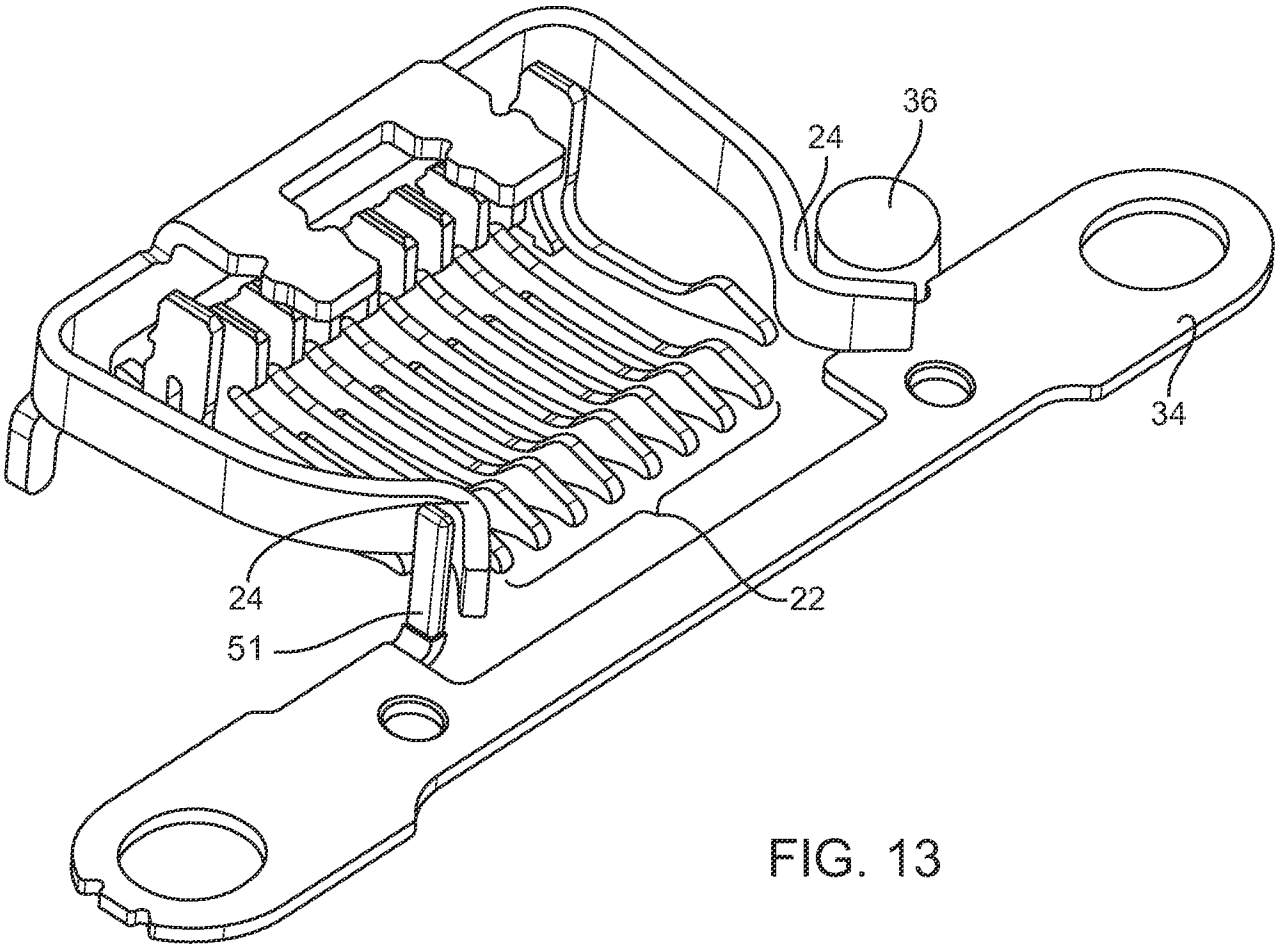

FIG. 13 illustrates an alternative embodiment in which the backup spring comprises a cylindrical elastomeric member 36, such as a cylindrical member comprising an elastomer so that the cylinder acts as a spring to exert an inward force. Although shown here as a cylindrical member, it is appreciated that this member may be any of a variety of shapes. Typically, the cylindrical member 36 is positioned adjacent the curved portion of the spring arms as shown in FIG. 13, and may be attached to the brackets, 32, 34, the receptacle housing 30 or any suitable component so as to function as a stress reducing member as described above. While FIG. 13 shows a bent tab portion backup spring 51 on one side and a cylindrical member backup spring 36 on the other, the embodiment could have cylindrical elastomeric members on each side and the bent portion is not required to be used in combination with the elastomeric member, although many varied combinations of backup springs may be used in various embodiments.

Figure 14:
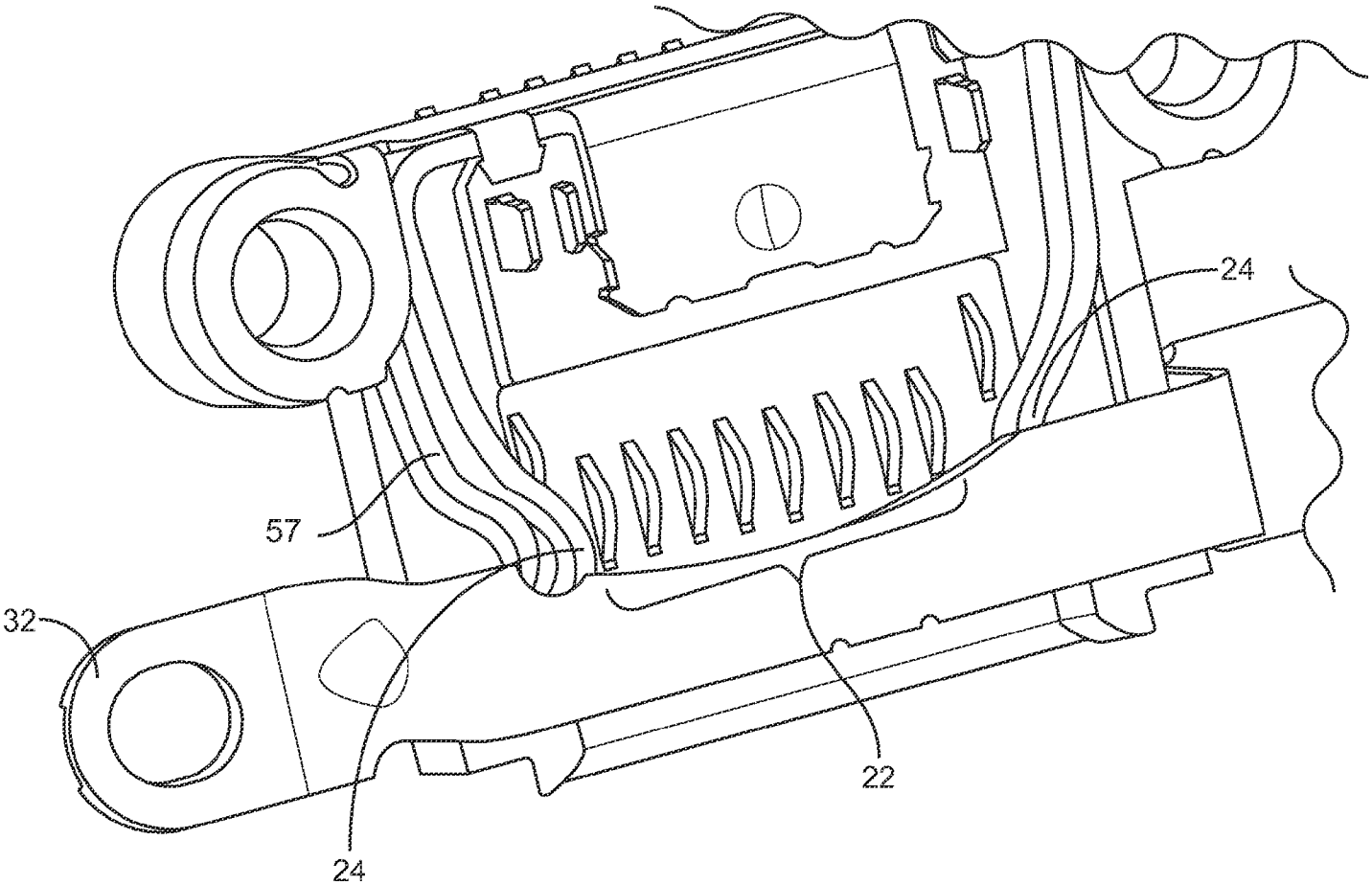

FIG. 14 illustrates an alternative embodiment in which the backup spring comprises a complementary spring arm 57 similar to that of the resilient arms 24' defining the retention features 24. The complementary spring arm 57 is shown on one side for convenience of illustration, and typically a complementary spring arm 57 is included outside of each spring arm. By utilizing a backup spring having a complementary shape that conforms to the shape of the outside surface, the backup spring 57 may contact the spring arms along a length or along multiple points on the outward facing surface. This may further distribute the forces along the length of the spring arm and help to further prolong the useful life and reduce stress points within the spring arms. In such embodiments, the backup spring is a complementary spring arm 57, which may be formed as part of the same bracket that forms the retention features 24, or alternatively may be formed from one or both of the brackets or another suitable component. In this embodiment, as in other embodiments, the contact between the backup spring 57 and the spring arms involves metal-to-metal contact. To reduce any wear and tear on the components as well as to reduce the potential formation of metal dust from such contact, a suitable lubricant, such as PTFE and molybdenum grease, may be used between the backup spring 57 and the spring arms. Additionally, such lubricants may be used in any of the embodiments described herein where metal-to-metal contact between components may occur.

Figure 15A:
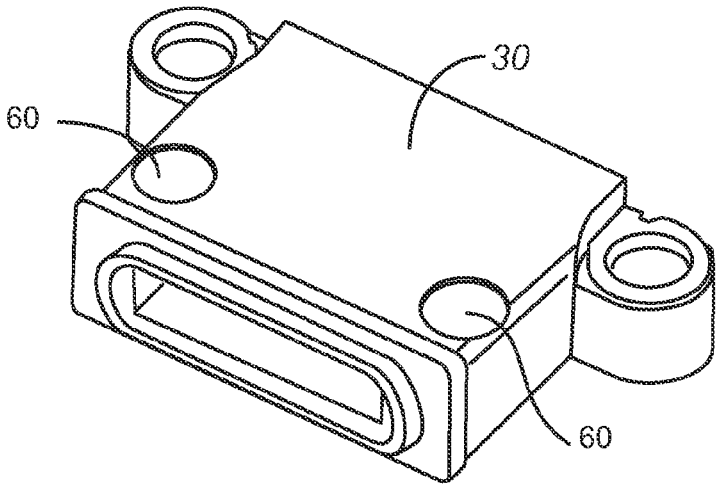
FIGS. 15A-15C show an example electrical connector receptacle assembly, a connector receptacle, and a lubricating member, respectively.
Figure 15C:
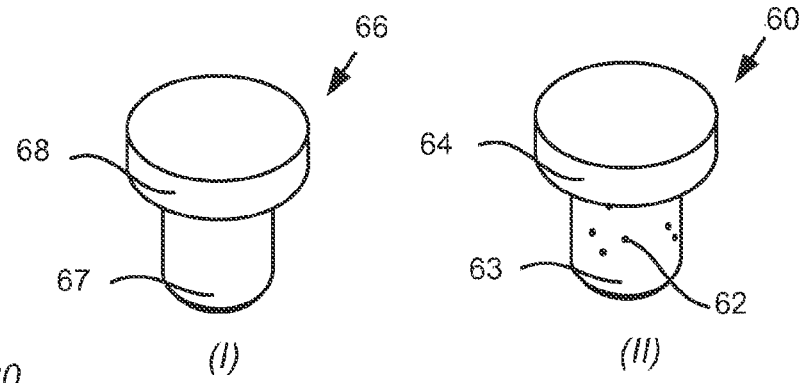
Figure 15B:
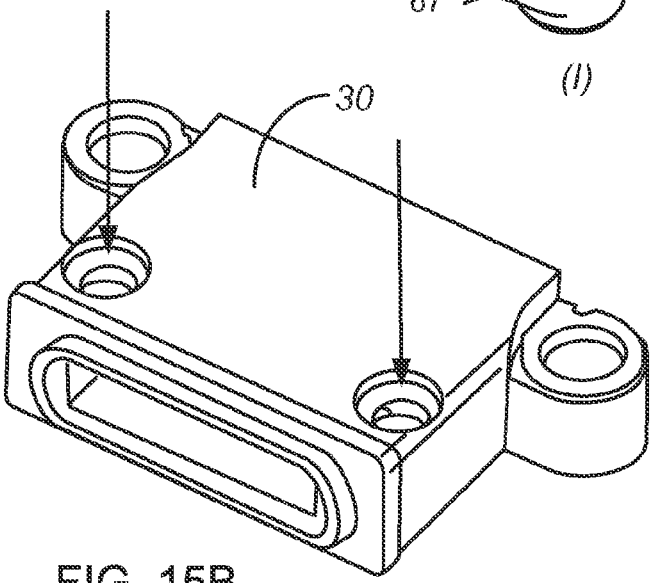

FIGS. 15A-16C illustrate another embodiment using an elastomeric backup spring positionable adjacent the spring arm retention feature through corresponding holes within the receptacle housing 30 (indicated by the arrows in FIG. 15B). This feature is advantageous as the elastomeric backup spring can be easily removed and replaced with another elastomeric backup spring as needed to allow for adjustment of the retention force. Various types of elastomeric members may be used, such as the cylindrical elastomeric member 66 (e.g. cylinder I in FIG. 15C) or a cylindrical elastomeric member 60 (e.g. cylinder II in FIG. 5C), the cylinders being removeable so they can be interchanged as desired or replaced periodically over time. This aspect allows the members to be easily replace should the supply of lubricant therein become exhausted over time. In certain applications where a greater retention force is desired, the backup springs 60 or 66 could be easily replaced with backup springs having a greater spring force or with backup springs having differing dimensions without disassembling the housing. In some embodiments, the removable backup springs 60 and 66 are configured with a flange or head portion 64 and 68, respectively, and a shaft 63 and 67, respectively extending a distance away from the head, the head typically having a greater diameter than the shaft. This configuration is advantageous in that when the self-lubricating members 60 or 66 are inserted into the corresponding holes in the receptacle housing 30, the flange or head portion of each is received within a countersink or recess of the corresponding hole so as to seal each hole. The head portion and shaft may be made from differing materials or may be made from the same elastomeric material which allows for a seal between the head and the receptacle housing 30.

Figure 16A:
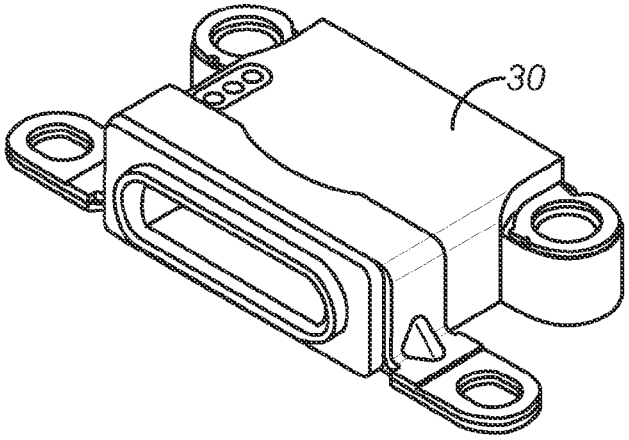
FIGS. 16A-16C illustrate an example electrical connector receptacle assembly.
Figure 16B:
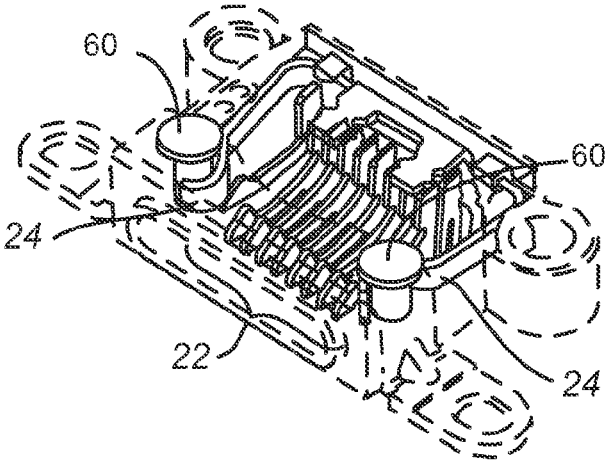
Figure 16C:
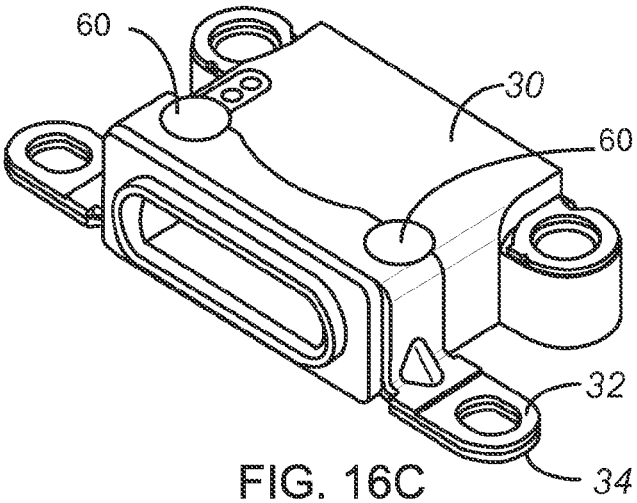

As shown in FIGS. 169 and 16C, an upper bracket 32 (such as shown in FIG. 16A) may be modified to allow access to the holes in the receptacle housing 30 for insertion of the backup spring, which may comprise a lubricating member 60. As seen in FIG. 16B, when the backup spring 60 is inserted within the holes, the shaft 38 extends alongside an outer facing surface of each of the retention features 24 to allow for improved retention capabilities and fatigue strength as described previously. As seen in FIG. 16C, the backup spring 60 remains accessible even when coupled within a device by upper and lower brackets 32, 34 so as to allow for adjustment of the retention force by removal and/or replacement of the backup spring 60.

Figure 17A:
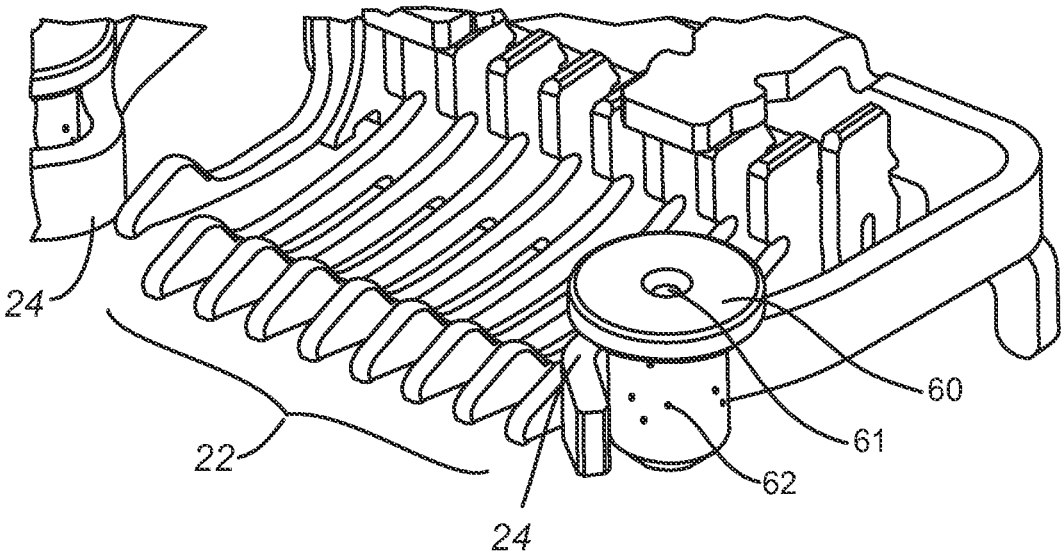
FIGS. 17A-17B illustrate an example retention feature and a self-lubricating backup spring.
Figure 17B:
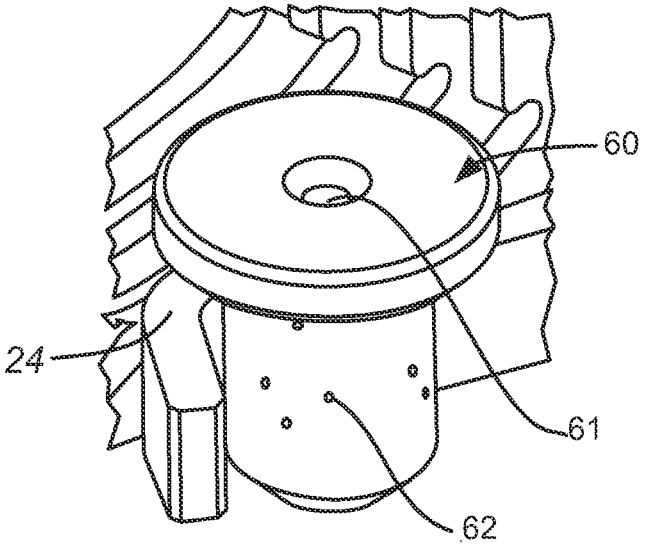
Figure 18:
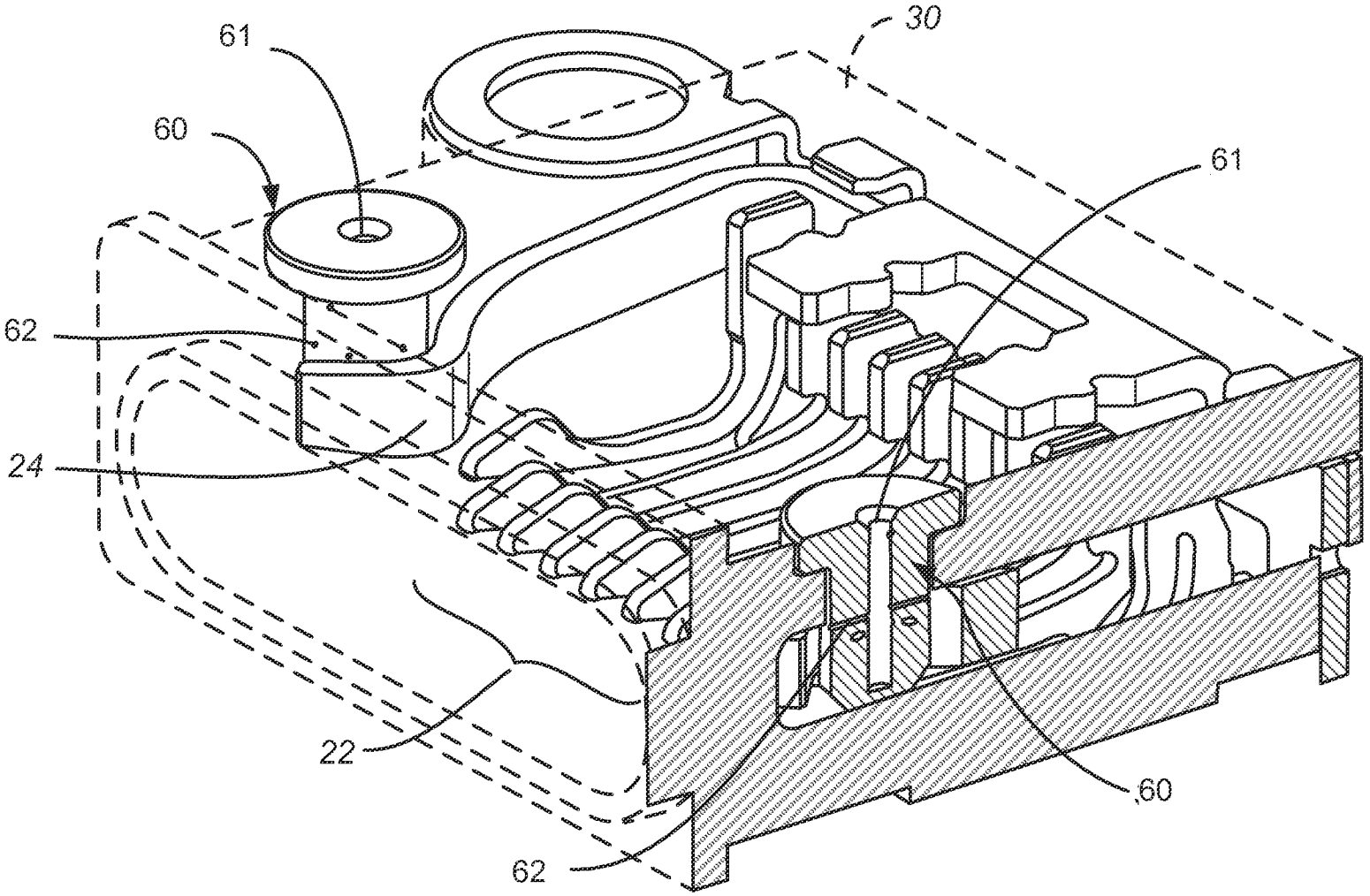
FIG. 18 illustrates a replaceable self-lubricating backup spring in an example electrical connector receptacle assembly.

FIGS. 17A-17B illustrate additional aspects associated with use of self-lubricating backup springs, described previously. The lubricating member 60 is shown positioned outside the pair of retention features 24. The lubricating member 60 may be fabricated from an elastomer designed to slowly release either a liquid or solid lubricant onto the adjacent components to prolong the lubricated life of the parts. The lubricating member 60 may comprise an inherently porous or sponge-like material that is pre-infused with a desired lubricant so as to release the lubricant upon contact or when pressure is applied. Each lubricating member 60 may also include an internal reservoir 61 containing a lubricant to be released through small channels or pores 62 in fluid communication with the reservoir 61 that slowly release particles as each lubricating member 60 is engaged, such as by contact or applied pressure, with each cycle of use. Each lubricating member 60 includes a central reservoir 61, such as shown in FIG. 18. The reservoir may be accessible via an access opening to allow for re-filling of the reservoir or the reservoir could be sealed and each lubricating member 60 switched out when the lubricant in the reservoir is exhausted. FIG. 18 illustrates an example of the components in FIGS. 17A-17B as positioned within an example receptacle housing, the housing including access holes to allow insertion of the lubricating member 60 into the connector receptacle or replacement of each lubricating member 60 periodically over the lifetime of the device.

Figure 19:
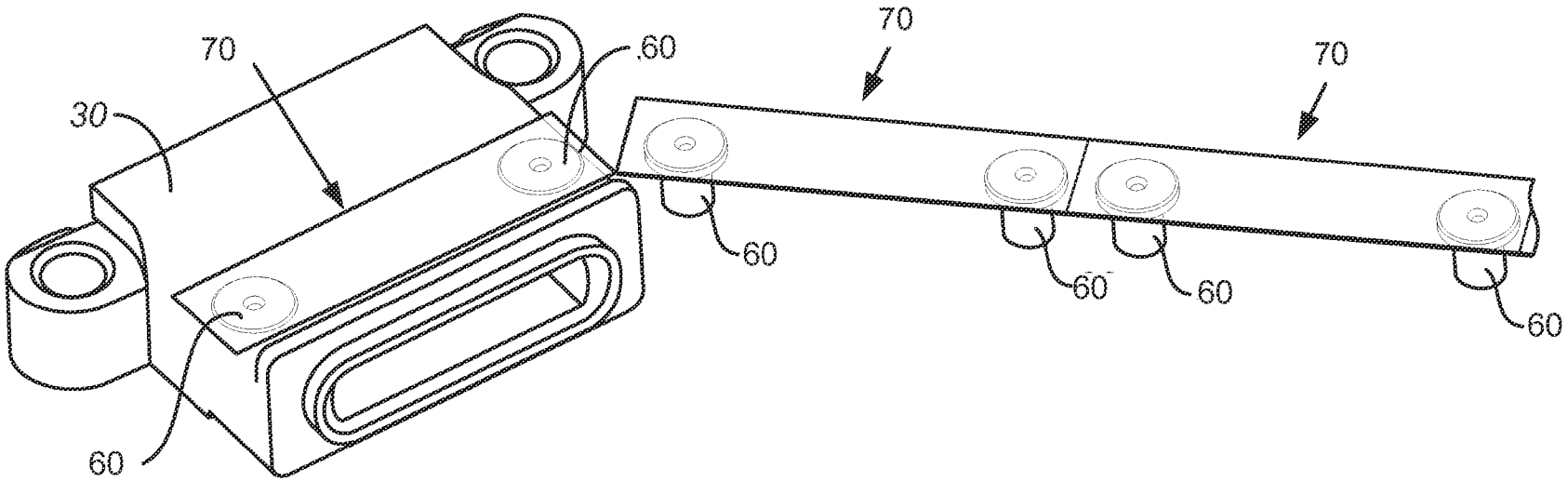
FIG. 19 shows pre-fabricated strips, each strip having a pair of lubricating members for use with a connector receptacle assembly.

FIG. 19 illustrates strip 70 having lubricating member 60 thereon to allow for quick and easy assembly of the lubricating member 60 into the receptacle housing 30 and to further allow for easy replacement of lubricating member 60 as desired. In this embodiment, each strip 70 includes a pair of lubricating member 60 disposed thereon and positioned for dual insertion of the lubricating member 60 into the corresponding holes of the receptacle housing 30. The strip 70 may be fabricated from a thin plastic or any material suitable for use with the connector assembly. The pair of lubricating members may be fixedly attached or removably attached to the strip, such as with an adhesive, snap-fit, or other suitable attachment means. In one aspect, the lubricating member 60 each have a head and a shaft, the head being wider than the shaft and the top surface of the head being attached to a bottom surface of the strip. The strip 70 may be included in a pre-fabricated roll, each strip being detachable from the roll, or the strip 70 may be pre-fabricated as separate strips. In some embodiments, the strip 70 may also be used to seal the access opening of the reservoirs in the lubricating member 60. Although the strip 70 may be configured to peel away after insertion, the strip 70 may be configured to remain attached to the lubricating member 60 to facilitate easy removal of the lubricating member 60 for replacement.

Figure 21A:
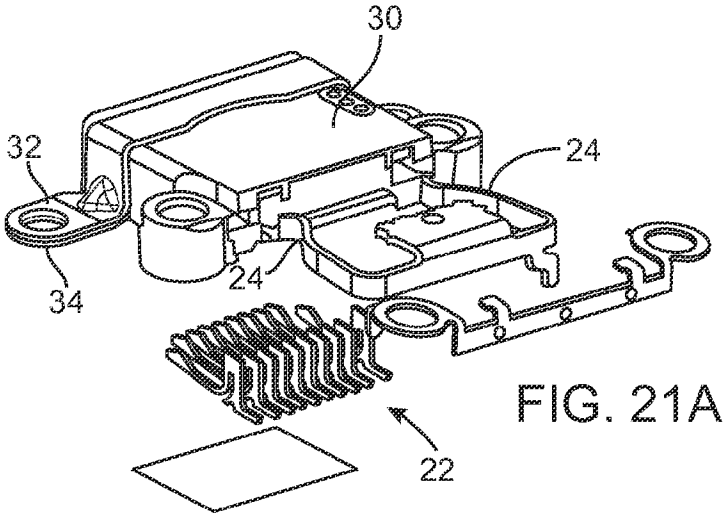
FIGS. 20A-22 show an example electrical connector receptacle.
Figure 21B:
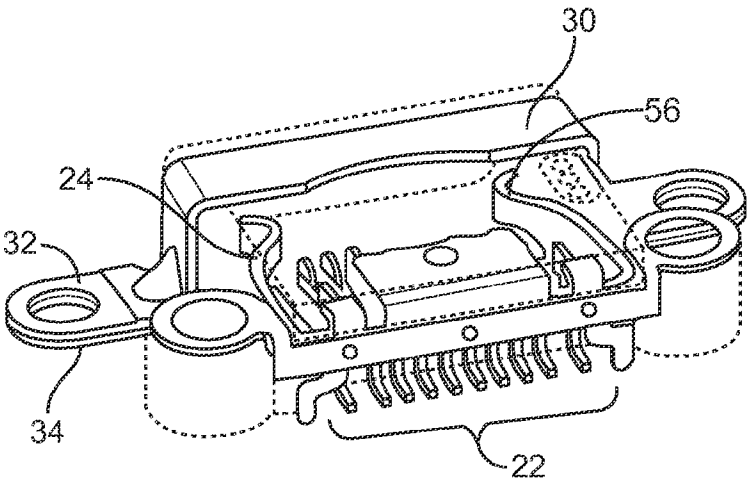
Figure 20A:
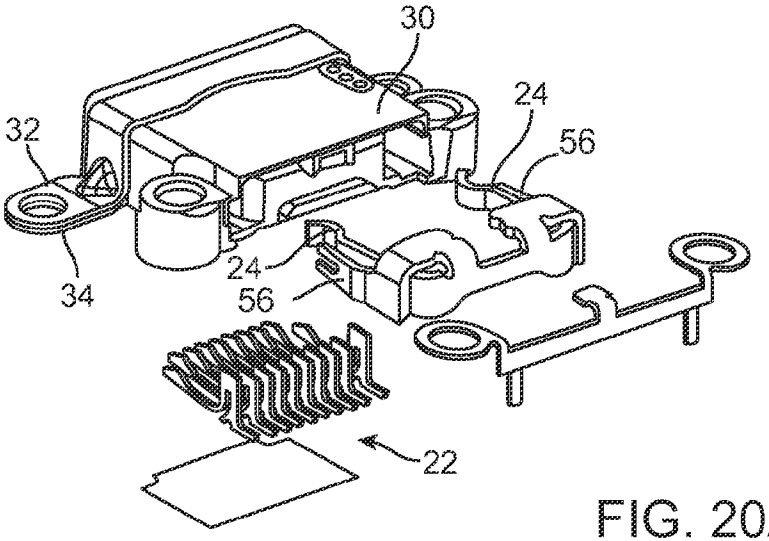
Figure 20B:
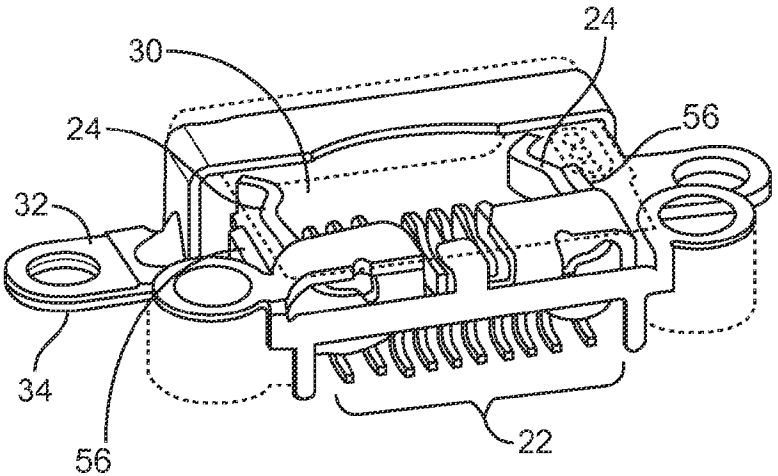

FIGS. 20A-20B illustrate another embodiment in which the backup spring comprises a dual backup spring 56, where two opposing dual backup springs 56 are formed from the same component. In some embodiments, the dual backup springs 56 extend from a base of the bracket defining the spring arm retention features 24 such that the dual backup springs 56 are integrated with the spring arm retention feature bracket (compared to a typical spring arm retention feature bracket shown in FIGS. 21A-21B). Typically, the dual backup springs 56 extend only along a portion of the spring arm retention feature 24 and are not necessarily complementary or conforming in shape, such as in the embodiment in FIG. 14.

Figure 22:
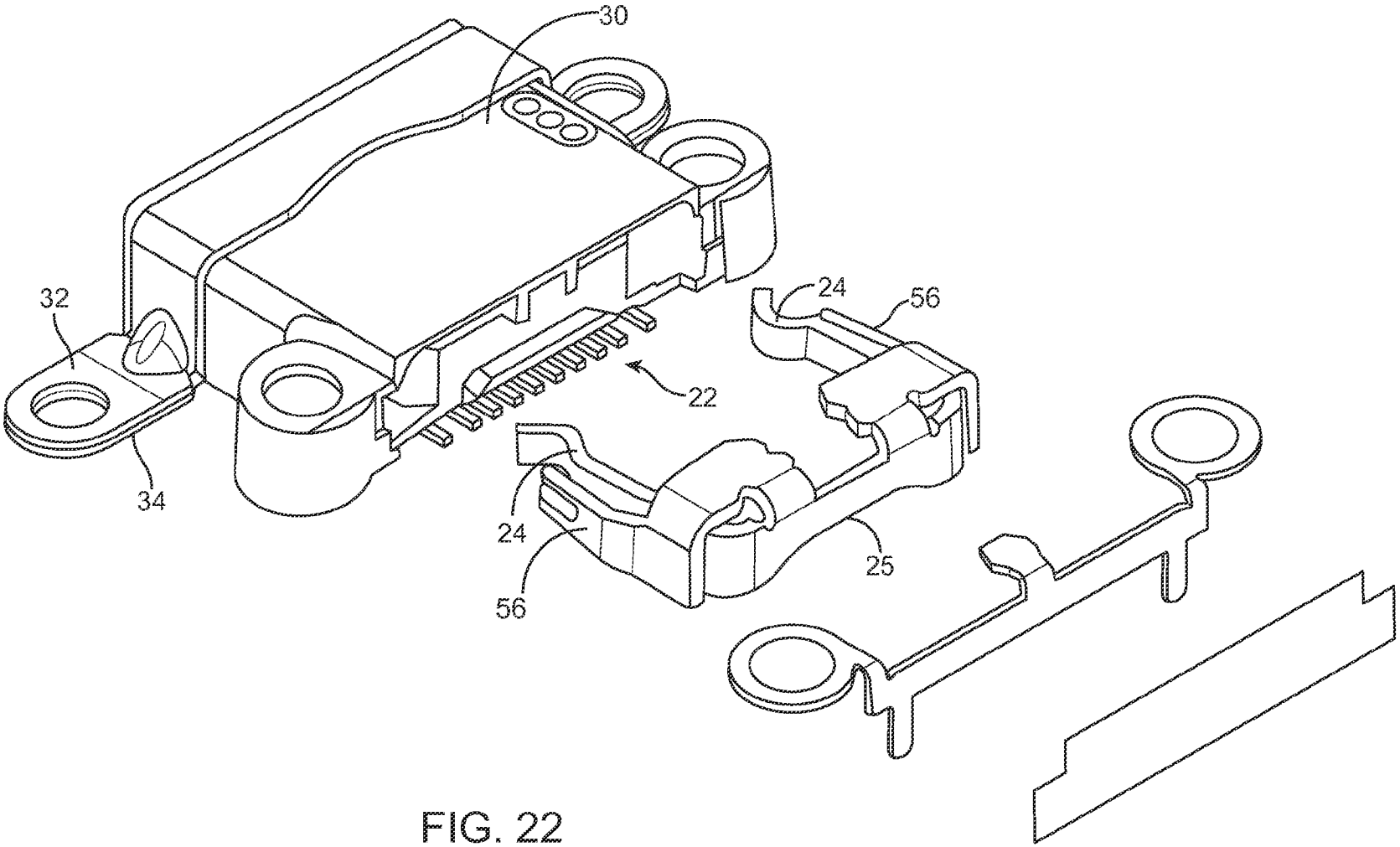

In one aspect, the relatively short dual backup springs 56 may have improved strength as compared to the spring arm retention feature 24. This embodiment can be further understood by referring to FIG. 22 which illustrates the spring arm retention feature 24 bracket having dual backup springs 56 attached to the base 25 of the bracket and extending alongside an outer facing surface of each spring arm retention feature 24. This configuration is advantageous as it allows for improved retaining capabilities and fatigue strength while still allowing space around outside the curved portion of the spring arm retention feature 24 for other components (such as one or more additional backup springs in this area).

Forming opposing dual backup springs 56 as part of the same component is further advantageous as it splits the spring load across the dual backup springs 56 improving both the insertion and retraction forces, reducing the stress load on the components and improving fatigue life of the connector assembly. Stress analysis tests performed on example prototypes of this design fabricated from stainless steel having a Young's modulus of 186000 N/mm$^2$ and a Yield stress of 1300 N/mm$^2$ indicated a displacement of 0.565 mm, an applied force of 14.1 N and a stress peak of 1400 N/mm$^2$.

Figure 23:
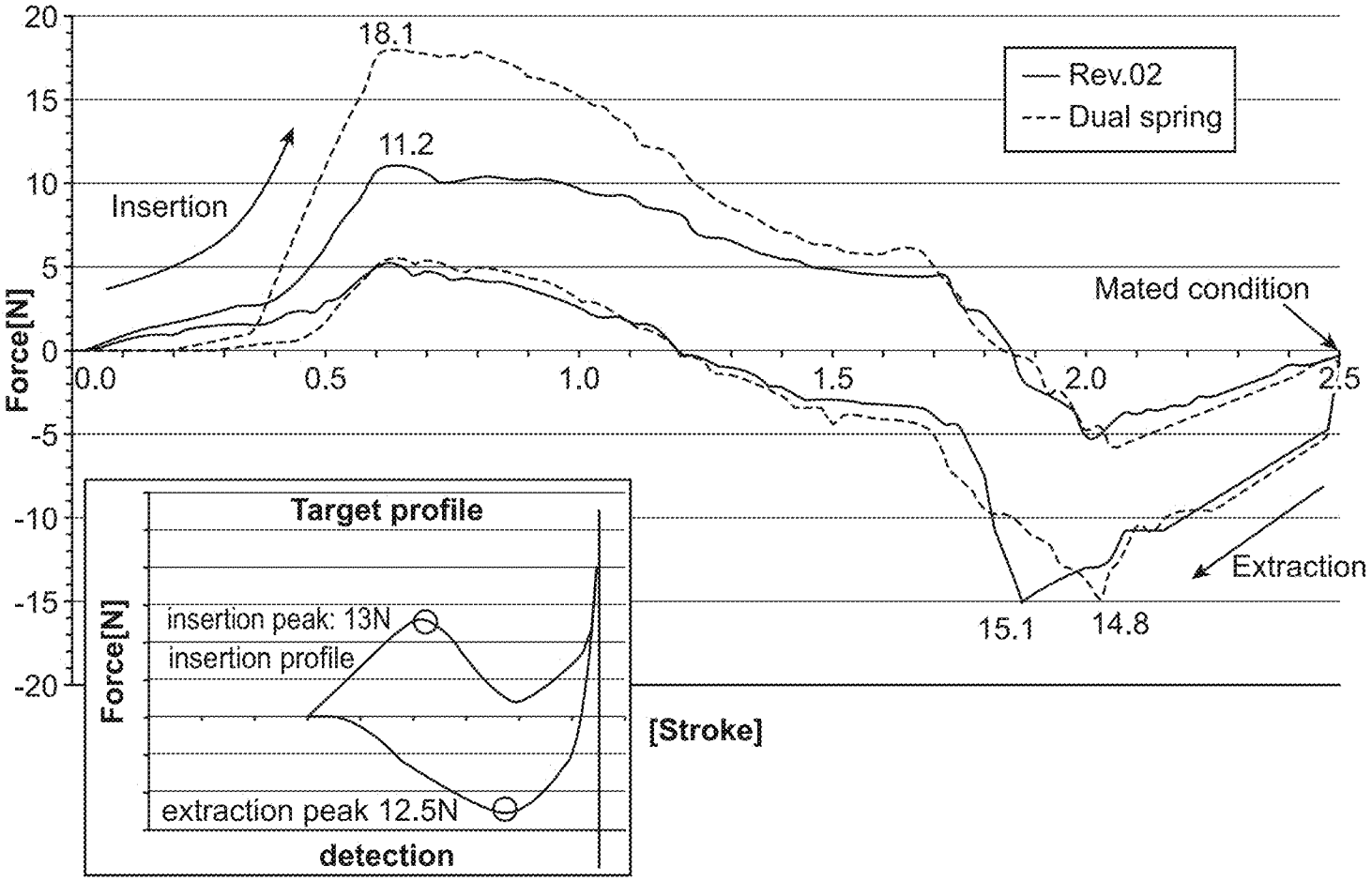
FIG. 23 shows the insertion and retraction force profile as seen in the electrical connector embodiment shown in FIG. 19.

FIG. 23 shows a graph of insertion and retraction forces that illustrates testing results of a dual spring embodiment as compared to a single spring embodiment. The graph indicates a reduction in the peak insertion force from 18.1 N (achieved in prior designs) to 11.2 N with the dual backup spring design. As can be seen in the insert graph of FIG. 23, the insertion and extraction profile provided by the dual backup spring design is closer to that of the desired insertion and retraction forces shown in the target profile. Table 2 below provides mechanical characteristics obtained in a finite element analysis of a mechanism using the dual spring design as compared against alternative designs without the dual backup spring.

TABLE 2

Comparison of Mechanical Characteristics

| | Dual Spring type | Rev 02 modified | Rev 02 | Rev 15 | Target |
|---|---|---|---|---|---|
| Displacement (mm) | 0.565 | 0.52 | 0.52 | 0.645 | — |
| Normal Force (N) | 14.1 | 21.7 | 21.7 | 9.6 | — |
| Stress Peak (N/mm$^2$) | 1400 | 2500 | 2500 | 2022 | — |
| Insertion Force (N) | 11.2 | (18.1) | 18.1 | — | 13 |
| Extraction Force (N) | 15.1 | (1438) | 14.8 | — | 12.5 |

Although in various described embodiments, various types of backup springs are shown as being formed from the same component and integrated with the retention feature bracket, it is appreciated that the dual backup springs may also be formed from a component that is separate from the spring arm retention feature bracket and maintain many of the advantages described above. Additionally, it is appreciated that this embodiment may be used in conjunction with any of the embodiments described herein.

Figure 24:
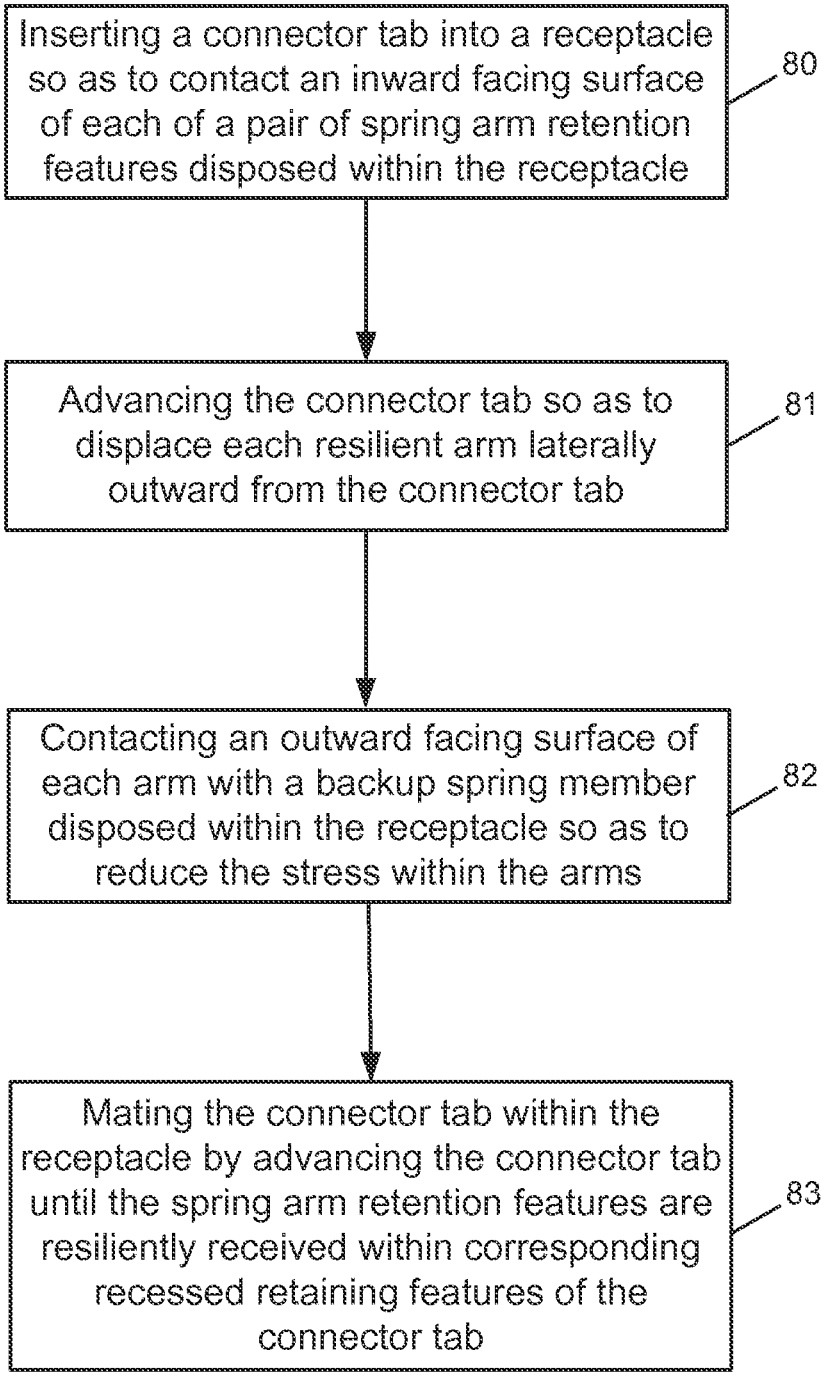
FIG. 24 shows an example method of use of a retention latch device.

FIG. 24 depicts methods for retaining an inserted component within a receptacle in accordance with some embodiments. An exemplary method for retaining a tab within a receptacle in an electrical connector assembly includes: inserting a connector tab into the receptacle so as to contact an inward facing surface of each of a pair of spring arm retention features disposed within the receptacle (step 80); advancing the connector tab so as to displace each resilient arm laterally outward from an insertion axis along which the connector tab is inserted (step 81); contacting an outward facing surface of each arm with a corresponding backup spring member disposed within the receptacle (step 82); exerting a force with the backup spring member so as to reduce the stress within the arms; and mating the connector tab within the receptacle by advancing the connector tab until the spring arm retention features are resiliently received within corresponding recessed retaining features of the connector tab (step 83).

Figure 25:
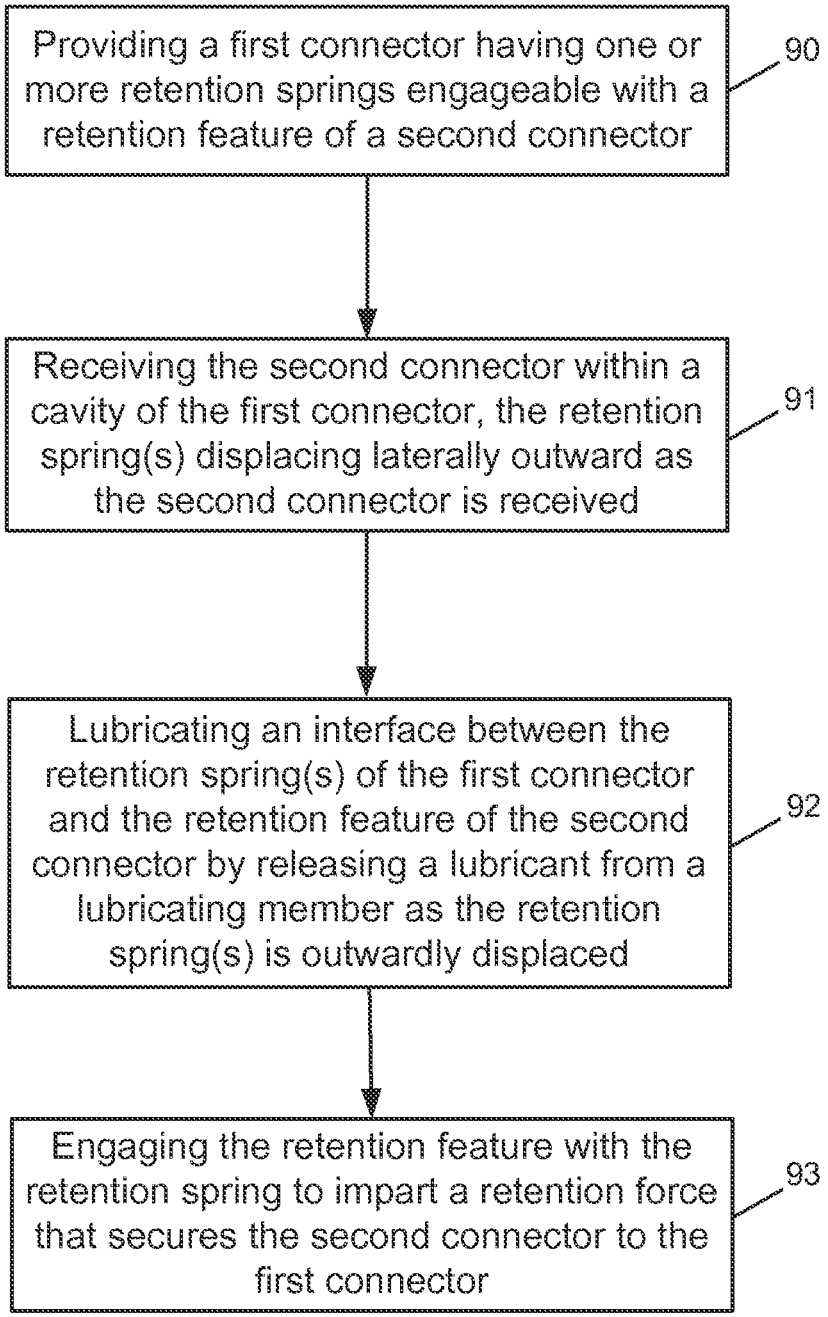
FIG. 25 shows an example method of retaining a connection in an electrical connector.

FIG. 25 depicts an example method for retaining an inserted component while maintaining a lubricated state of the retention components. The example method includes: providing a first connector having one or more retention springs engageable with a retention feature of a second connector (step 90); receiving the second connector within a cavity of the first connector, the retention springs displacing laterally outward as the second connector is received (step 91); lubricating an interface between the retention springs of the first connector and the retention feature of the second connector by releasing a lubricant from a lubricating member onto the retention springs during outward displacement (step 92); and engaging the retention feature with the retention spring to impart a retention force that secures the second connector to the first connector (step 93).

The above described embodiments are intended to illustrate examples of certain applications of the invention in relation to electrical connectors, and the invention is not limited to these embodiments. It is appreciated that any of the components described in any of the embodiments may be combined and or modified in accordance with the invention. For example, an embodiment may include a combination of one or more of the backup springs described herein within an electrical connector or other such application, or may include one or more variations and equivalents to the features described herein as would be clear given the disclosure provided herein.

What is claimed:

1. A method of connecting electrical components comprising:

providing a first connector having a cavity with one or more retention springs disposed therein and a second connector for insertion into the cavity to electrically couple the first connector with the second connector, wherein the one or more retention springs are slidably engageable with a retention feature of the second connector;

receiving the second connector within the cavity of the first connector by displacing the one or more retention springs laterally outward as the second connector is inserted;

lubricating the one or more retention springs of the first connector and the retention feature of the second connector by releasing a lubricant from a lubricating member; and engaging the retention feature with the one or more retention springs to impart a retention force to secure the second connector to the first connector when the second connector is mated within the first connector.

2. The method of claim 1, wherein lubricating the one or more retention springs of the first connector and the retention feature of the second connector comprises lubricating an interface between the one or more retention springs of the first connector and the retention feature of the second connector by releasing the lubricant from the lubricating member as the one or more retention springs are laterally displaced outward.

3. The method of claim 2, wherein lubricating the interface comprises contacting the lubricating member with the one or more retention springs as the one or more retention springs are laterally displaced.

4. The method of claim 1, wherein lubricating comprises releasing the lubricant through a porous surface of the lubricating member as the one or more retention springs presses against the lubricating member during outward displacement.

5. The method of claim 1, wherein lubricating comprises releasing the lubricant from a lubricant reservoir within the lubricating member as the one or more retention springs presses against the lubricating member.

6. The method of claim 1, wherein the lubricating member comprises an elastomeric cylindrical member disposed adjacent an outer facing surface of the one or more retention springs.

7. The method of claim 1, wherein each of the one or more retention springs comprises a spring arm, wherein the lubricating member acts as a backup spring when contacted by the spring arm so as to reduce the stress in the spring arm.

8. The method of claim 7, wherein the one or more retention springs comprise a pair of opposing retention springs, the retention feature comprises a pair of retention features, and the lubricating member comprises a pair of lubricating members positioned adjacent outside of the pair of opposing retention springs.

9. The method of claim 8, wherein the pair of lubricating members are provided on a strip, the method further comprising:

replacing the pair of lubricating members positioned within a receptacle of the first connector by removing the strip and replacing with another strip having lubricating members provided thereon in pre-determined positions to facilitate insertion of the lubricating members through holes within the receptacle housing.

10. A lubricating component for use with an electrical connector, the lubricating component comprising:

a pair of lubricating members for placement adjacent opposing retention springs in a connector receptacle so that insertion of a connector plug tab into the connector receptacle displaces the retention springs to engage the lubricating members, the opposing retention springs being affixed within the connector receptacle so as to engage with corresponding retention features of the connector plug tab when mated within the connector receptacle, wherein each of the lubricating members includes a lubricant releasable upon engagement with the retention springs and acts as a backup spring upon engagement with the retention springs during insertion of the connector plug tab; and a strip on which the pair of lubricating members are attached to facilitate positioning and/or replacement of the pair of lubricating members by positioning the strip on a receptacle housing of the connector receptacle.

11. The lubricating component of claim 10, wherein the strip comprises a thin plastic substrate and each of the lubricating members comprises a head and a shaft, the head being wider than the shaft, wherein the head of the lubricating member is attached to a bottom surface of the strip.

12. The lubricating component of claim 11, wherein each of the lubricating members comprises a porous elastomeric material infused with the lubricant so that the lubricant is released when the lubricating member is contacted by the respective retention spring.

13. The lubricating component of claim 10, wherein the pair of lubricating members are spaced apart on the strip so as to correspond to a pair of holes on the receptacle housing such that positioning of the strip on the receptacle housing inserts the pair of lubricating members into the corresponding pair of holes into position within the connector receptacle.

14. An electronic connector comprising:

a receptacle housing that defines a cavity;

a plurality of electrical contacts positioned within the cavity;

a retention mechanism for releasably coupling an electronic connector plug tab inserted within the cavity, the retention mechanism including first and second opposing retention springs disposed on opposite sides of the cavity, each configured to engage with a retention feature of the connector plug tab when the connector plug tab is mated within the cavity; and first and second elastomeric back-up springs positioned within the cavity and spaced apart from the first and second opposing retention springs, respectively, such that each retention spring is disposed between the respective elastomeric back-up spring and the cavity, wherein each of the first and second back-up springs comprise a porous elastomeric material infused with a lubricant and is positioned such that during insertion of the connector plug tab into the cavity, the respective retention spring contacts the back-up spring compressing the elastomeric material thereby releasing the lubricant to the retention spring.

* * * * *